US011511925B2

(12) United States Patent
Guirguis

(10) Patent No.: US 11,511,925 B2
(45) Date of Patent: Nov. 29, 2022

(54) SYSTEMS AND METHODS FOR NESTING PRODUCT PACKAGING WITH STRAINER INSERTS

(71) Applicant: Sameh Guirguis, Shelton, CT (US)

(72) Inventor: Sameh Guirguis, Shelton, CT (US)

(73) Assignee: Pianca Packaging LLC, Englishtown, NJ (US)

( * ) Notice: Subject to any disclaimer, the term of this patent is extended or adjusted under 35 U.S.C. 154(b) by 202 days.

(21) Appl. No.: 16/751,672

(22) Filed: Jan. 24, 2020

(65) Prior Publication Data

US 2021/0229890 A1 Jul. 29, 2021

(51) Int. Cl.

| | |
|---|---|
| ***B65D 81/26*** | (2006.01) |
| ***B65D 21/02*** | (2006.01) |
| ***B65D 43/02*** | (2006.01) |
| ***B65D 85/34*** | (2006.01) |

(52) U.S. Cl.

CPC ..... *B65D 81/262* (2013.01); *B65D 21/0233* (2013.01); *B65D 43/0208* (2013.01); *B65D 85/34* (2013.01); *B65D 2543/00194* (2013.01); *B65D 2543/00296* (2013.01); *B65D 2543/00657* (2013.01); *B65D 2543/00685* (2013.01)

(58) Field of Classification Search

CPC ..... B65D 81/262; B65D 21/0233; B65D 43/0208; B65D 85/34; B65D 2543/00194; B65D 2543/00296; B65D 2543/00685; B65D 81/24; B65D 81/261; B65D 21/0238; B65D 21/04; B65D 85/345; B65D 25/04; B65D 81/26; B65D 21/00; B65D 21/02; B65D 21/043; B65D 21/045; B65D 21/046; B65D 21/06

USPC ..... 426/106; 206/499, 514, 505

See application file for complete search history.

(56) References Cited

U.S. PATENT DOCUMENTS

| | | | | |
|---|---|---|---|---|
| 186,929 | A | 2/1877 | Hamilton | |
| 347,665 | A | 8/1886 | Vail | |
| 423,740 | A | 3/1890 | Coons | |
| 539,698 | A | 5/1895 | Milligan | |
| 718,517 | A | 1/1903 | Perry | |
| 1,161,727 | A | 11/1915 | Randall | |
| 2,128,118 | A | 8/1938 | Burford | |
| 3,698,783 | A * | 10/1972 | Swett | B65D 43/0218 312/351 |

(Continued)

FOREIGN PATENT DOCUMENTS

| | | |
|---|---|---|
| JP | 2011078699 | 7/2012 |
| WO | WO1998042590 | 10/1998 |

*Primary Examiner* — James N Smalley
*Assistant Examiner* — Laura E. Parker
(74) *Attorney, Agent, or Firm* — Ziegler IP Law Group, LLC

(57) ABSTRACT

Systems and methods for nesting product packaging with strainer inserts are provided. Product packaging systems may include, for example, a product container with a lid and with a strainer insert disposed within the container. In some embodiments, the strainer inserts may be snapped into place in a channel, groove, or other retention feature of the parent container, thus permitting coupling without the use of adhesives or fasteners. The strainer inserts, when coupled within the parent containers, may define a drainage volume in which product fluids may drain to maintain the product separately from the fluids, e.g., to prolong shelf-life of the product.

13 Claims, 14 Drawing Sheets

(56) References Cited

U.S. PATENT DOCUMENTS

| | | | | |
|---|---|---|---|---|
| 3,756,681 | A * | 9/1973 | Croston | B65D 81/262 312/351 |
| 3,885,727 | A | 5/1975 | Gilley | |
| 6,257,540 | B1 | 7/2001 | Kresch | |
| 6,695,138 | B1 | 2/2004 | Colombo et al. | |
| 7,921,992 | B2 * | 4/2011 | LaRue | B65D 81/265 206/557 |
| 8,474,610 | B1 * | 7/2013 | Knight | B65D 81/262 206/204 |
| 9,826,860 | B2 | 11/2017 | Hanson et al. | |
| 2004/0200844 | A1 * | 10/2004 | Watzke | B65D 81/262 220/501 |
| 2010/0176022 | A1 * | 7/2010 | Furlong | B65D 43/0214 206/508 |

* cited by examiner

SYSTEMS AND METHODS FOR NESTING PRODUCT PACKAGING WITH STRAINER INSERTS

BACKGROUND

There have been many efforts directed to improving consumer product packaging, and in particular, packaging for fresh or perishable products such as fruit and vegetables. Fresh-cut fruit and vegetables, for example, offer unique packaging challenges due to the fact that the contained material itself (i.e., the cut fruit) alters the atmosphere within the packaging (due to natural decomposition) and because the exposed surfaces (i.e., the cut surfaces) accelerate product decomposition. Fresh-cut products also cause natural juice seepage (or "bleeding") that both enhances product breakdown and is generally unsightly to consumers. While various designs and solutions have been proposed to address these and other problems that reduce the shelf-life of fresh-cut products, such solutions are generally costly and/or have failed to maximize shelf-life times.

The most common solutions to managing bleeding or off-juicing of fresh and/or fresh-cut products are the introduction of absorbent pads into containers (typically of clear plastic) of fresh products or the incorporation of raised surfaces at the bottom of the containers (to promote drainage). While absorbent pads do offer shelf-life and some consumer perception advantages, they are costly to implement—e.g., increasing packaging material cost, increasing product packaging procedure costs, increasing shipping costs, and increasing potential problems with waste disposal and/or recycling. Pads may become oversaturated and thereby lose their effectiveness and pads may also be prone to fostering undesirable odors. Drainage structures formed in the bottom of the containers are generally either too short to provide for adequate juice storage or are too widely spaced apart, thereby permitting product components (e.g., cut fruit pieces or smaller whole fruit pieces such as grapes) to fall into the drainage spaces where they are exposed to the juices.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Embodiments herein comprise systems and methods for nesting product packaging with insert and/or strainer elements that solve some or all of the deficiencies of previous systems. Product packaging systems described herein, for example, may permit fresh produce such as fresh-cut fruit products to be packaged in nesting containers while increasing shelf-life and decreasing per unit costs. In some embodiments, insertable and/or nesting strainers may be constructed of PolyEthylene Terephthalate ("PET") and/or other thermoplastic polymers such that they may be recycled and/or otherwise handled in the same process stream as the containers in which they are inserted.

According to some embodiments, product packaging systems may comprise a product container with a lid and with a strainer insert disposed within the container. In some embodiments, the strainer inserts may be snapped into place in a channel, groove, or other retention feature of the parent container, thus permitting coupling without the use of adhesives (which may not be desirable for use with foods products and/or may cause problems with recycling processes) or fasteners (which would increase per unit costs and could also cause recycling problems).

II. Nesting Product Packaging Systems With Strainer Inserts

Figure 1A:
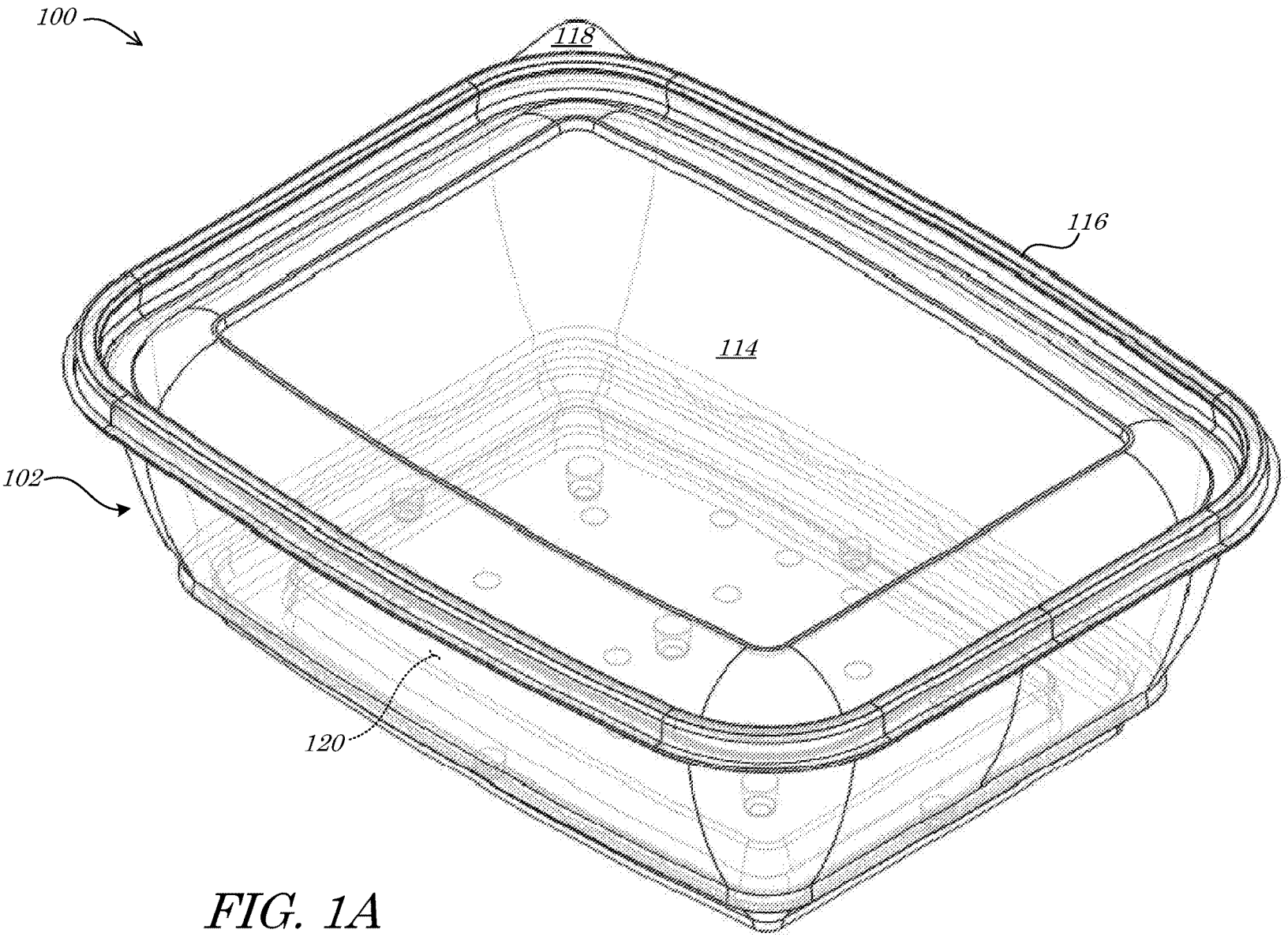
FIG. 1A, FIG. 1B, FIG. 1C, FIG. 1D, FIG. 1E, FIG. 1F, FIG. 1G, FIG. 1H, and FIG. 1I are perspective (with lid), perspective (without lid), top (without lid), bottom, front, back, left, right, and cross-sectional views of a nesting product packaging system according to some embodiments.
Figure 1B:
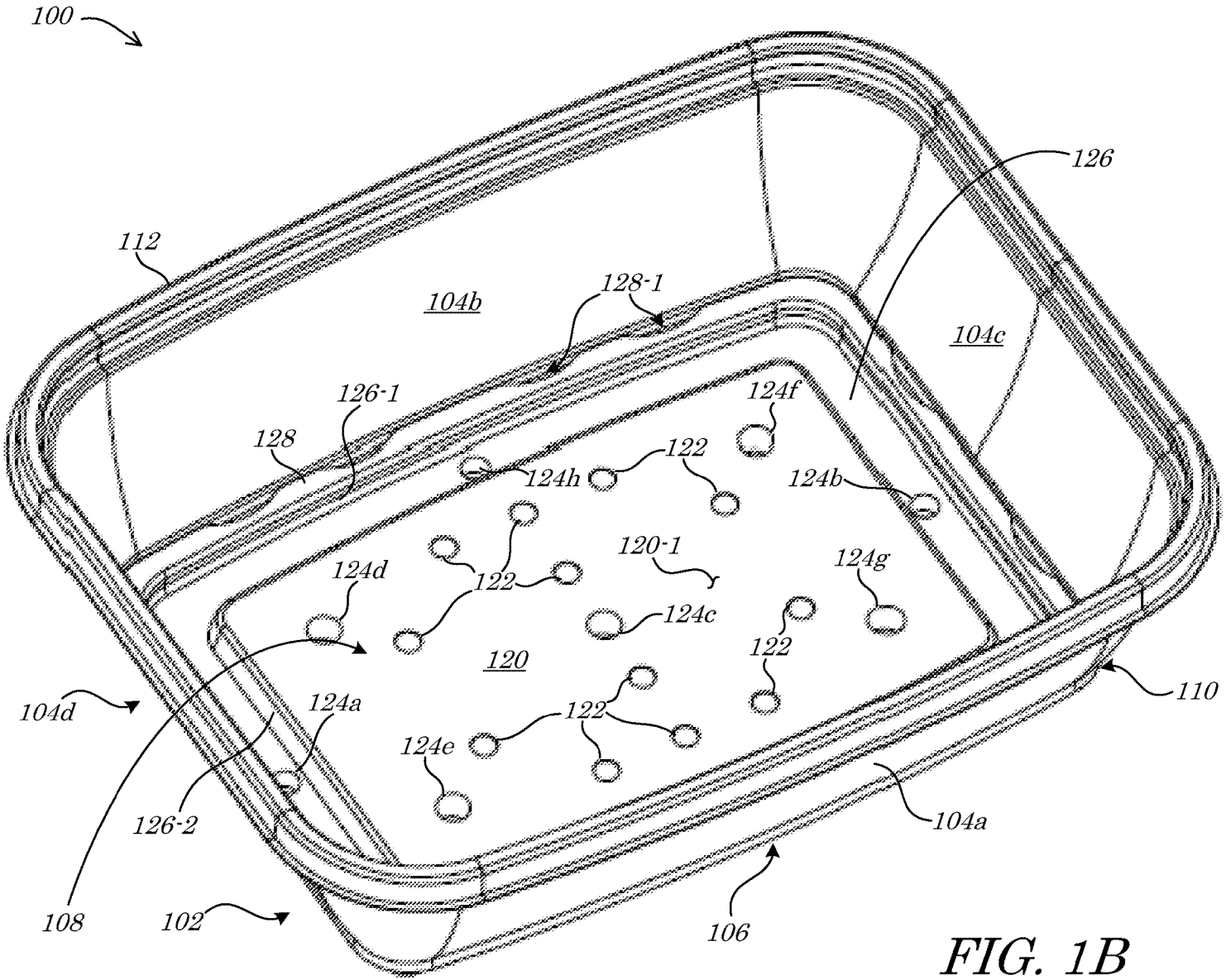
Figure 1C:
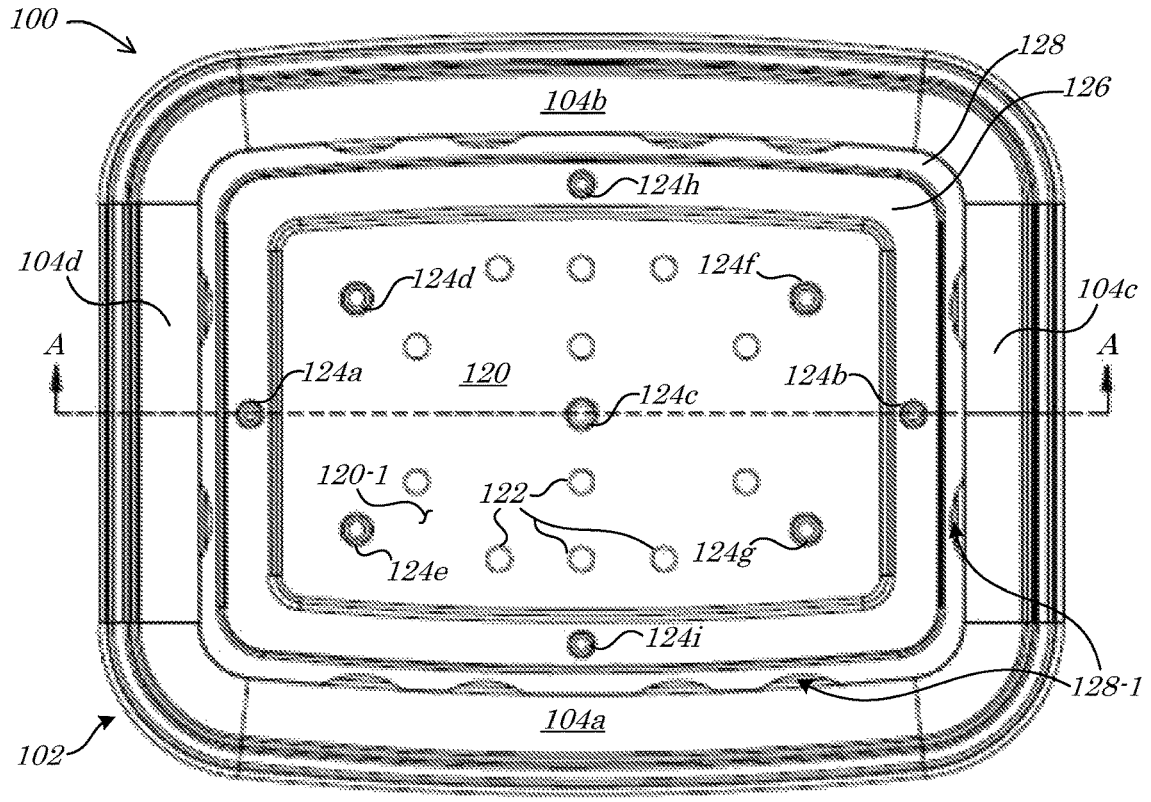
Figure 1D:
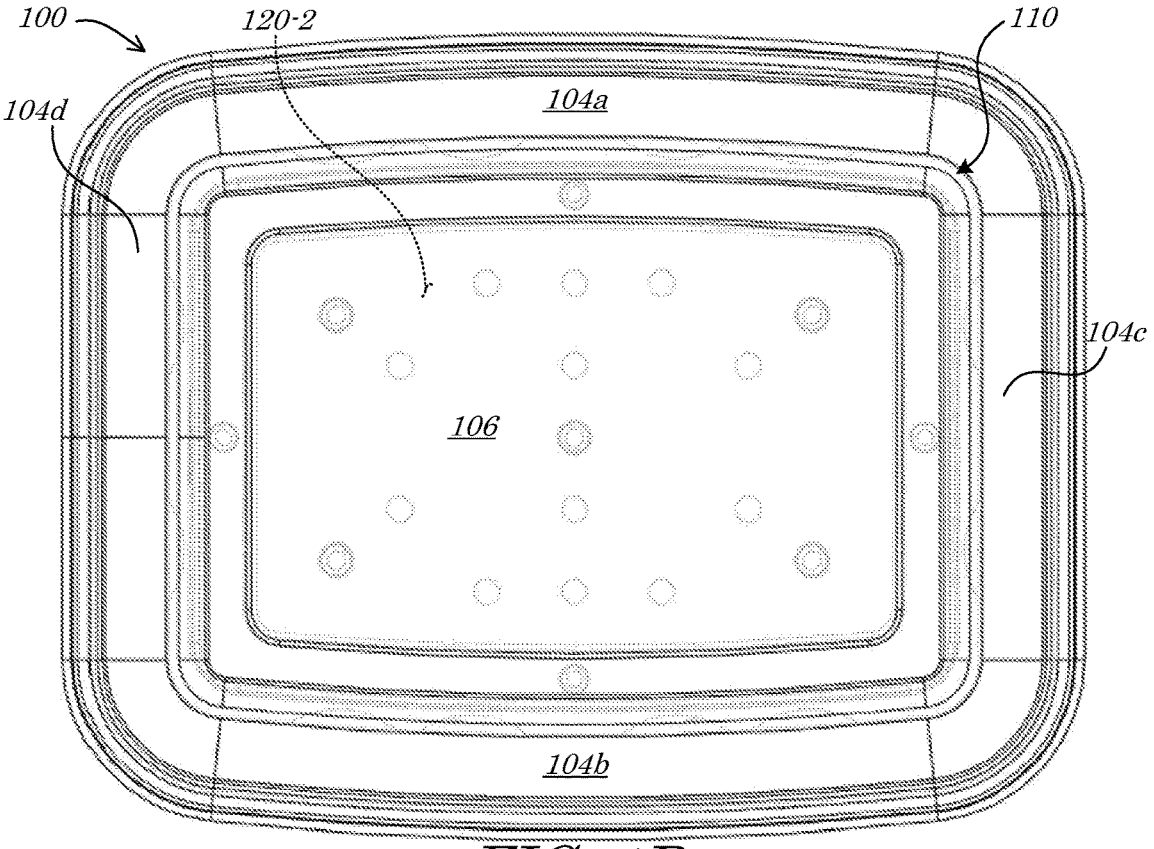
Figure 1E:
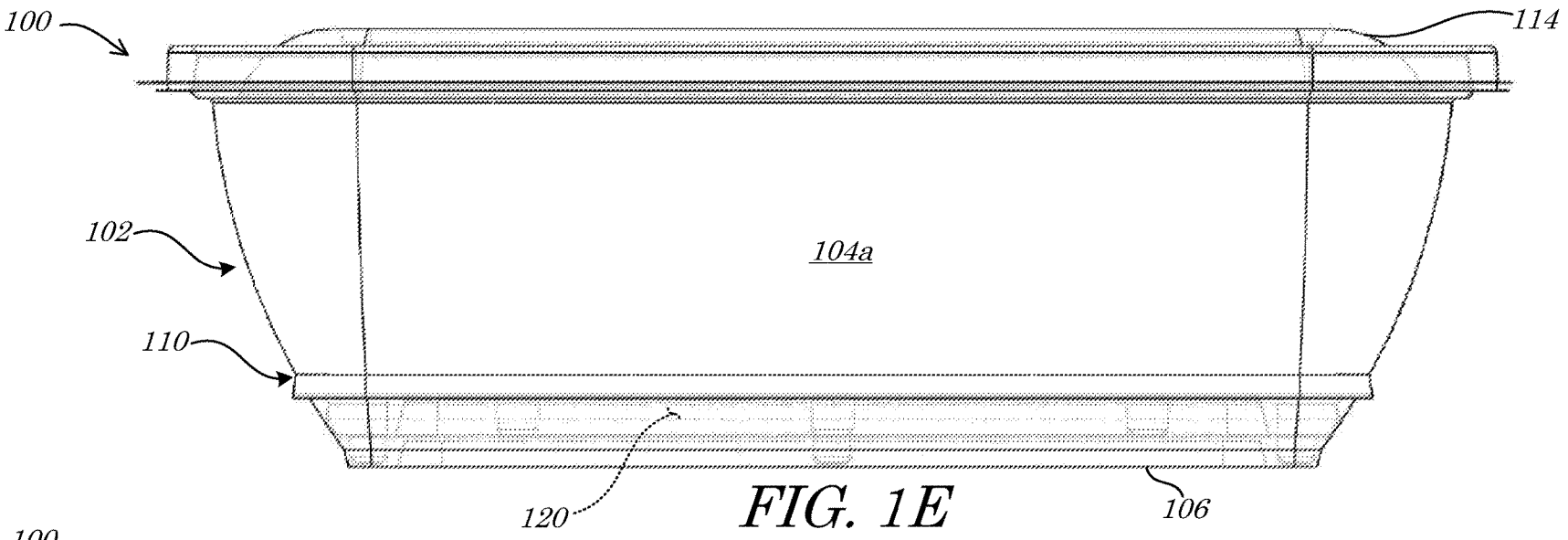
Figure 1F:
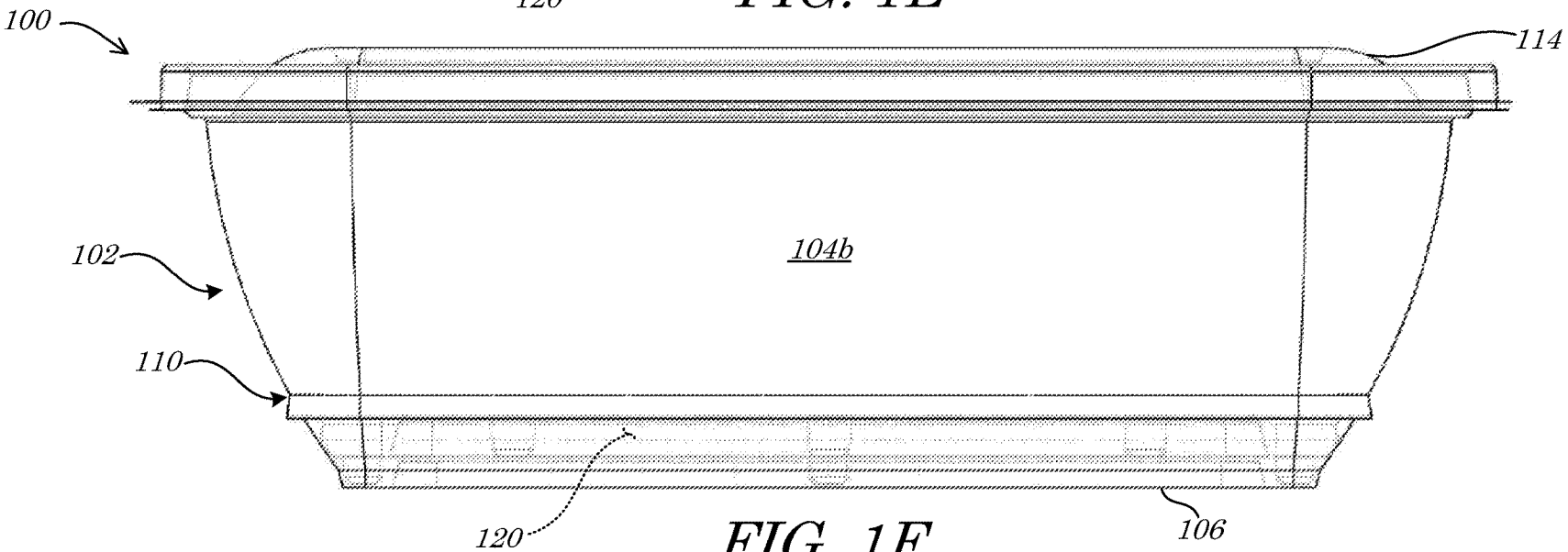
Figure 1G:
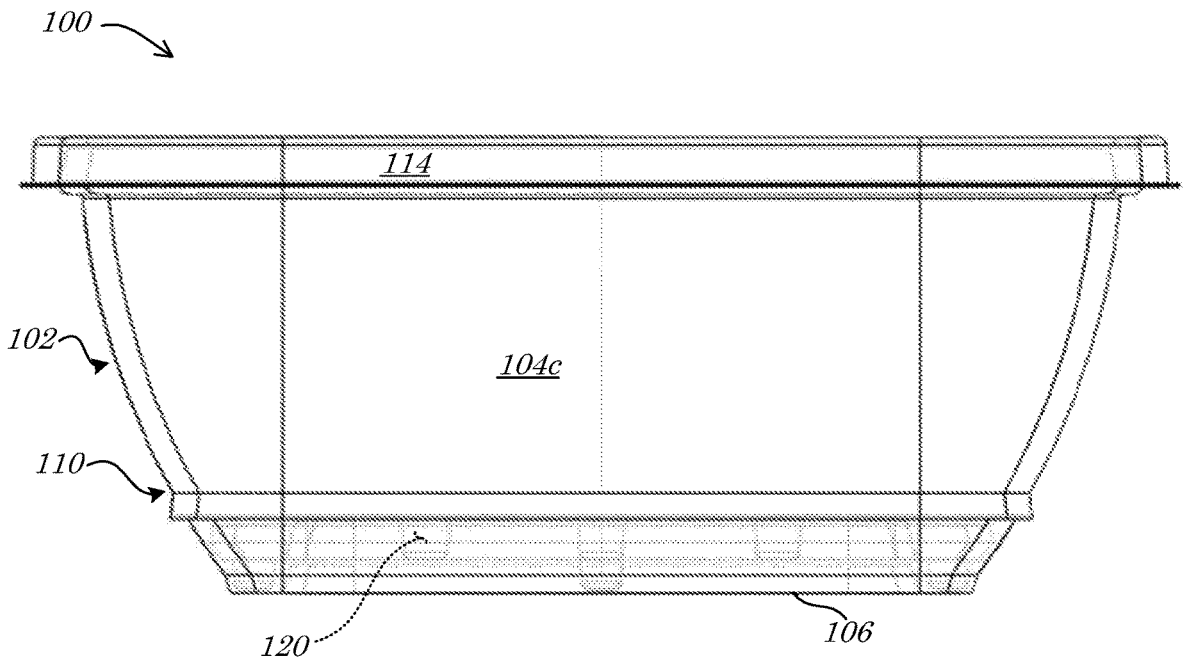
Figure 1H:
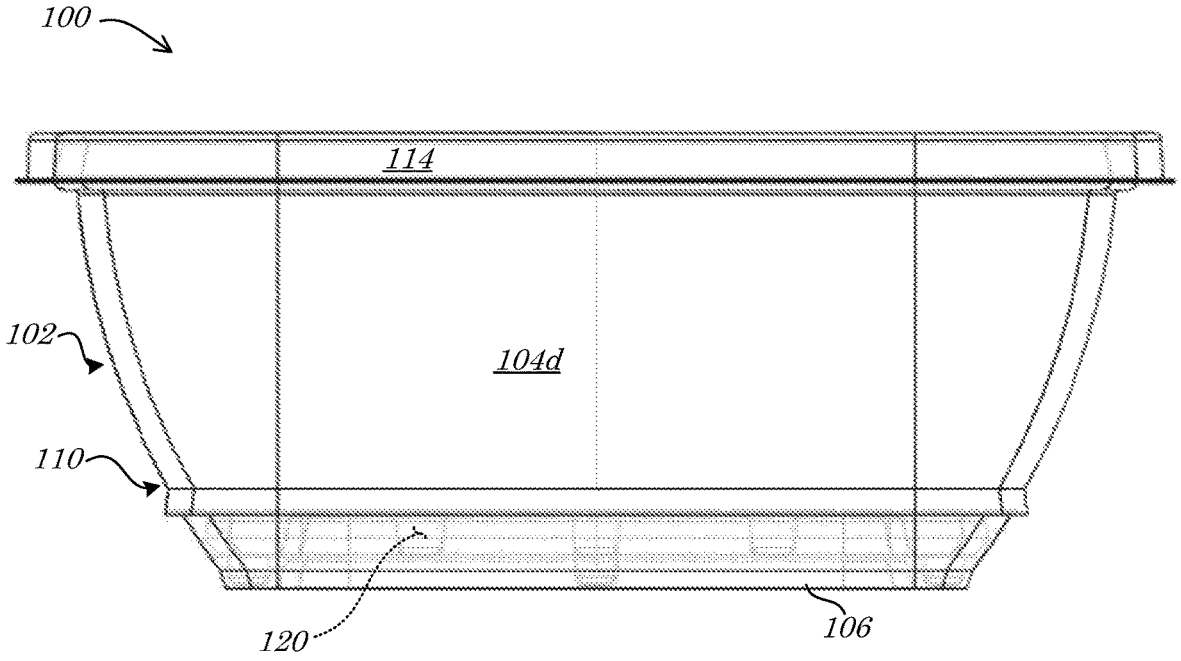
Figure 1I:
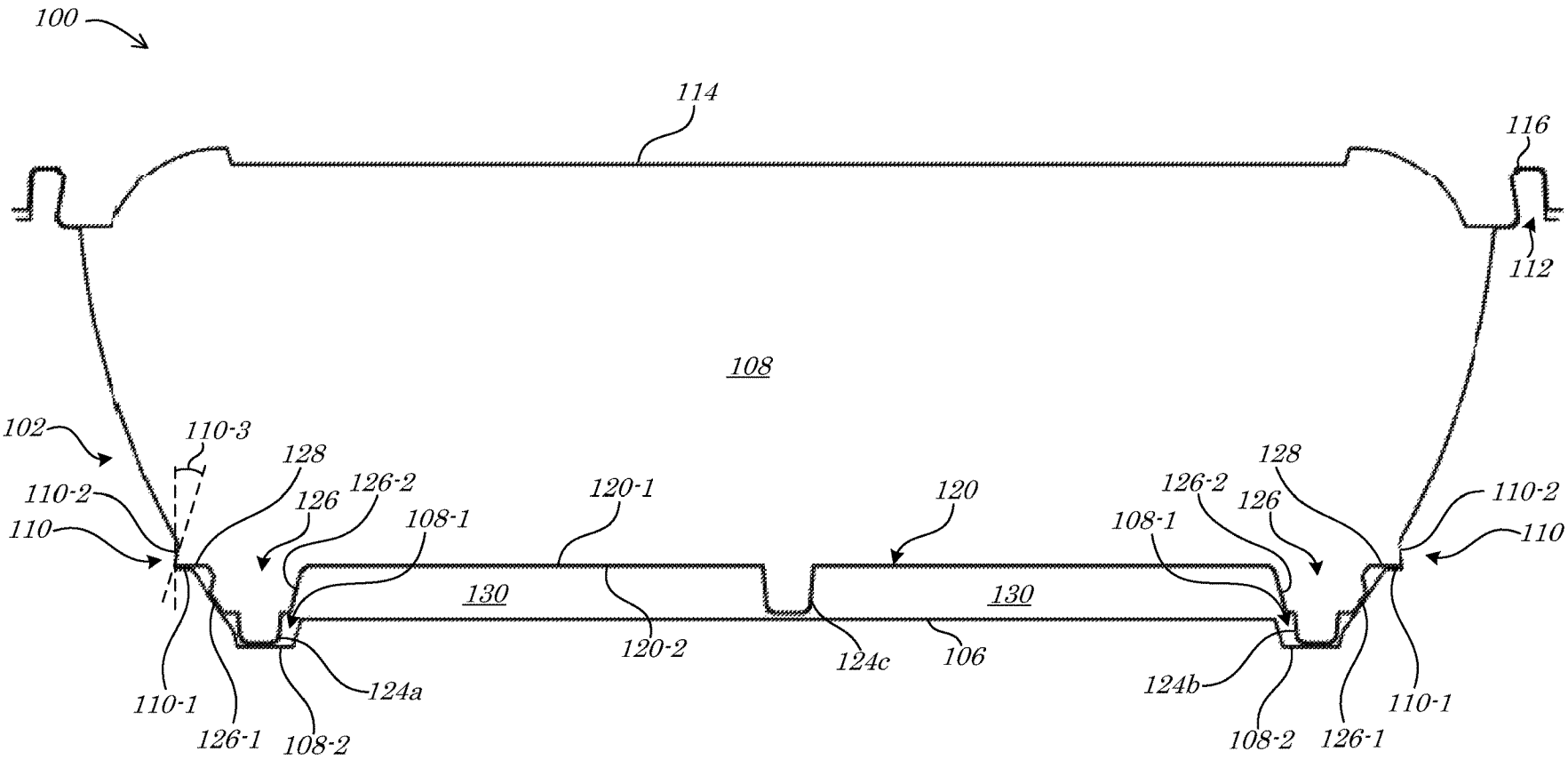

Referring initially to FIG. 1A, FIG. 1B, FIG. 1C, FIG. 1D, FIG. 1E, FIG. 1F, FIG. 1G, FIG. 1H, and FIG. 1I, perspective (with lid), perspective (without lid), top (without lid), bottom, front, back, left, right, and cross-sectional views of a nesting product packaging system 100 according to some embodiments are shown. The system 100 may comprise, for example, a container 102 such as the generally rectangular-shaped container 102 depicted. In some embodiments, the container 102 may be designed and/or manufactured in different sizes and/or configurations such as, but not limited to, square, round, and oval container shapes. According to some embodiments, the container 102 may comprise four (4) sides such as a front side 104*a*, a back side 104*b*, a left side 104*c*, and a right side 104*d*, as depicted. In some embodiments, the container 102 may comprise a bottom 106 coupled to lower extents of the various sides 104*a-d*, thereby defining an interior container volume 108. The container volume 108 may generally be utilized to store any desirable product (not shown) such as fresh produce and/or fresh cut fruit and/or vegetables. According to some embodiments, the container may be constructed from PET and/or other desirable plastic materials that may typically be formed with a thickness of between seventeen and forty thousandths of an inch or mils (17-40 mil). In some embodiments, the container 102 may be formed to comprise a perimeter channel 108-1 having a channel bottom 108-2 extending below (or beyond) the container bottom 106. According to some embodiments, the container 102 may be transparent, such as depicted in FIG. 1A, such that any product stored within the container volume 108 may be readily visible to (and accordingly inspected by) consumers (not shown).

In some embodiments, the container 102 may be formed with and/or otherwise comprise a strainer detent 110. The strainer detent 110 may comprise, for example, a feature interrupting the geometry of one or more of the container sides 104*a-d* such as a longitudinal channel as depicted. According to some embodiments, the strainer detent 110 may comprise and/or define a detent floor 110-1 and/or a detent sidewall 110-2 (best viewed in the cross-sectional view of FIG. 11). In some embodiments, the detent floor

110-1 may be generally horizontal and/or parallel to a plane in which the container bottom 106 is disposed. According to some embodiments, the detent sidewall 110-2 may be vertically oriented at a retention angle 110-3 with respect to a perpendicular of the detent floor 110-1. As depicted in the cross-sectional view of FIG. 1I, for example, the retention angle 110-3 may comprise an acute angle with respect to a line perpendicular to the detent floor 110-1 such that the detent sidewall 110-2 is angled inwardly into the container volume 108.

According to some embodiments, the container 102 may comprise a mounting rim 112 or other feature or area via which a lid 114 may be removably coupled to cover the container volume 108. The lid 114 may comprise, for example, a mounting channel 116 such as the perimeter channel as depicted that is configured to mate with corresponding geometry of the mounting rim 112. As is well known in the art of thermoplastic forming and food container design, the mounting rim 112 and the mounting channel 116 may be cooperatively configured such that the lid 114 may be removably snapped onto the container 102. In some embodiments, the lid 114 may comprise a removal flange 118 that provides a surface via which a consumer (not shown) may grasp the lid 114 and apply lifting force to separate the mounting channel 116 from the mounting rim 112 (e.g., to gain access to the product stored in the container volume 108). According to some embodiments, various safety and/or tamper-evident features (not shown) may be provided to limit and/or govern access to the container volume 108 via lid 114 removal.

In some embodiments, a strainer insert 120 may be selectively and/or removably disposed within the container volume 108 and/or coupled to the container 102. The strainer insert 120 may comprise, for example, a thin plastic (e.g., PET) element defining an upper insert surface 120-1 and a lower insert surface 120-2. According to some embodiments, the upper insert surface 120-1 (and/or the lower insert surface 120-2) may be disposed horizontally within the container volume 108 and/or otherwise parallel to the container bottom 106. In some embodiments, such as in the case that the nesting product packaging system 100 is loaded with product and presented to consumers (e.g., for retail sale), the product stored in the container volume 108 may rest (e.g., due to gravitational forces) on the upper insert surface 120-1. According to some embodiments, the strainer insert 120 may comprise one or more drain holes 122 extending through the upper insert surface 120-1 and the lower insert surface 120-2 (best viewed in the perspective view (without the lid 114) of FIG. 1B) such that any juices or bleeding from the product may be drained away from the product.

According to some embodiments, the strainer insert 120 may comprise a plurality of standoffs 124*a-i* or feet that are disposed to rest on the container bottom 106 (and/or the drain channel bottom 108-1) and raise the upper insert surface 120-1 (and/or the lower insert surface 120-2) from the container bottom 106. In some embodiments, the strainer insert 120 may comprise a nesting pitch reduction channel 126 disposed between the upper insert surface 120-1 and the extents or perimeter of the strainer insert 120 and/or formed as an interrupting feature of the upper insert surface 120-1. The nesting pitch reduction channel 126 may, for example, reduce the nesting pitch or effective separation distance of nested strainer insert 120 and container 102 pairs, which allows for greater numbers of nested strainer insert 120 and container 102 pairs to occupy a given space (e.g., a shelf or box), thereby reducing storage and/or transportation costs. According to some embodiments, one or more of the standoffs 124*a-i* may be disposed and/or formed in (and/or otherwise coupled to) the upper insert surface 120-1. In some embodiments, one or more of the standoffs 124*a-i* may be disposed and/or formed in (and/or otherwise coupled to) the nesting pitch reduction channel 126. As best viewed in the perspective view (without the lid 114) of FIG. 1B and the top view (also without the lid 114) of FIG. 1C, for example, first, second, eight, and ninth standoffs 124*a*, 124*b*, 124*h*, 124*i* may be disposed in, on, and/or through the nesting pitch reduction channel 126 while third, fourth, fifth, sixth, and seventh standoffs 124*c-f* may be disposed in, on, and/or through the upper insert surface 120-1. According to some embodiments, the standoffs 124*a-i* may comprise differing heights and/or may contact the container 102 in different areas. As best viewed in the cross-sectional view of FIG. 1I, for example, in the case that the first and second standoffs 124*a*, 124*b* are formed in the bottom of the nesting pitch reduction channel 126 the first and second standoffs 124*a*, 124*b* may comprise a first height or length such that they rest in the drain channel bottom 108-2 of the container 102. In the case that the third standoff 124*c* is formed in the upper insert surface 120-1 (and/or the lower insert surface 120-2), the third standoff 124*c* may comprise a second height or length (e.g., different than the first height) such that it rests on the container bottom 106.

In some embodiments, the strainer insert 120 may comprise one or more features that engage and/or couple with the container 102. The nesting pitch reduction channel 126 may comprise an outer nesting surface 126-1 or outer channel wall that is positioned and/or angled to engage with a lower portion of one or more of the sides 104*a-d* of the container 102, for example, such that the strainer insert 120 is capable of maintaining a fixed position within the container 102 (e.g., during packaging, shipping, handling, etc.). In some embodiments, the nesting pitch reduction channel 126 may comprise an inner bevel 126-2 or inner channel wall disposed opposite from the outer nesting surface 126-1 and extending to the upper insert surface 120-1. According to some embodiments, the strainer insert 120 may comprise a perimeter flange 128 that is configured to rest on and/or couple to the detent floor 110-1. The perimeter flange 128 may comprise a flat portion of the strainer insert 120 that is substantially coplanar with the upper insert surface 120-1, for example, extending to the perimeter of the strainer insert 120 from an outside edge of the nesting pitch reduction channel 126. In some embodiments, the perimeter flange 128 and the upper insert surface 120-1 may be disposed in substantially parallel planes but may be configured to be oriented at different elevations. According to some embodiments, the dimensions of the strainer insert 120 may be configured such that the perimeter flange 128 extends onto or over the detent floor 110-1 and proximate to the juncture with the detent sidewall 110-2. In such a manner, for example, due to the retention angle 110-3 of the detent sidewall 110-2, once the perimeter flange 128 is engaged with the strainer detent 110 it may be impeded from unseating from the detent floor 110-1 by the overhanging detent sidewall 110-2. In some embodiments, the retention angle 110-3 may be alternatively measured and/or described as being between the detent sidewall 110-2 and the detent floor 110-1.

According to some embodiments, the configuration of the retention angle 110-3 and the perimeter flange 128 of the strainer insert 120 may allow for the strainer insert 120 to be removably snapped into place in the strainer detent 110 of the container 102. In some embodiments, either or both of the strainer insert 120 and the detent sidewall 110-2 (and/or the sides 104*a-d*) of the container 102 may comprise a degree of flexibility and/or elasticity (e.g., such as in the case that they are constructed from PET or other plastic) that allow for temporary deformation which permits the strainer insert 120 to be snapped into the strainer detent 110. In other words, the length and/or width of the strainer insert 120 may be temporarily shortened by deforming or warping the strainer insert 120 and/or the detent sidewall 110-2 and/or the retention angle 110-3 may be temporarily altered by bending the corresponding side 104*a-d* of the container 102, thereby permitting the strainer insert 120 to be forced into the strainer detent 110. In some embodiments, the strainer insert 120 may be similarly removed from the container 102 by application of a bending force to allow the perimeter flange 128 (or a portion thereof) to move past the inward extent of the detent sidewall 110-2, e.g., such as once the container has been utilized and is being disposed of and/or recycled. According to some embodiments, to facilitate removal of the strainer insert 120, to promote coupling of the perimeter flange 128 with the strainer detent 110, and/or to enhance and/or promote product drainage, the strainer insert 120 may comprise one or more cutouts 128-1 disposed in the perimeter flange 128. The cutouts 128-1 may permit a consumer to reach beneath the perimeter flange 128 such that bending and/or upward pressure may be applied for removal of the strainer insert 120 from the container 102 and/or may reduce the amount of bending or urging force necessary to urge the perimeter flange 128 into the strainer detent 110. The cutouts 128-1 may also or alternatively provide for drainage of product fluids. According to some embodiments for example, the drainage of such fluids may be achieved via the cutouts 128-1 and the drain holes 122 may not be required. As a process for cutting the drain holes 122 may add to manufacturing time and expense, it may be advantageous in some embodiments to eliminate the drain holes 122 and utilize the cutouts 128-1 for drainage. The cutouts 128-1 may be formed during a trimming process that occurs to separate individual strainer inserts 120 from a sheet of material and/or from other strainer inserts 120 (not shown), for example, and therefore reduce the need for additional manufacturing steps.

In some embodiments, the positioning of the strainer insert 120 within the container volume 108 may create and/or define a drainage volume 130 between the container bottom 106 and the lower insert surface 120-2. The drainage volume 130 may, for example, provide space in which juices from fresh-cut produce and/or other products may be drained, i.e., through the strainer insert 120, while the product is maintained away from the justices/fluids by the upper insert surface 120-1. According to some embodiments, the size of the drainage volume 130 may be configured for different products (e.g., with known and/or estimated volumes of bleeding) by altering (i) the heights of the standoffs 124*a-i*, (ii) the depth of the nesting pitch reduction channel 126, and/or (iii) the height of the strainer detent 110 with respect to the container bottom 106. Higher standoffs 124*a-i*, a deeper nesting pitch reduction channel 126, and/or a higher-positioned strainer detent 110, alone or in a desired combination for example, would increase the size of the drainage volume 130 and accordingly provide more space for product juices and/or fluids.

According to some embodiments, any or all of the components 102, 104*a-d*, 106, 108, 108-1, 108-2, 110, 110-1, 110-2, 110-3, 112, 114, 116, 118, 120, 120-1, 120-2, 122, 124*a-i*, 126, 126-1, 126-2, 128, 128-1, 130 of the nesting product packaging system 100 may be similar in configuration and/or functionality to any similarly named and/or numbered components described herein. Fewer or more components 102, 104*a-d*, 106, 108, 108-1, 108-2, 110, 110-1, 110-2, 110-3, 112, 114, 116, 118, 120, 120-1, 120-2, 122, 124*a-i*, 126, 126-1, 126-2, 128, 128-1, 130 (and/or portions thereof) and/or various configurations of the components 102, 104*a-d*, 106, 108, 108-1, 108-2, 110, 110-1, 110-2, 110-3, 112, 114, 116, 118, 120, 120-1, 120-2, 122, 124*a-i*, 126, 126-1, 126-2, 128, 128-1, 130 may be included in the nesting product packaging system 100 without deviating from the scope of embodiments described herein. For example, while certain numbers and configurations of drain holes 122 and standoffs 124*a-i* are depicted in the nesting product packaging system 100, different quantities and/or configurations of drain holes 122 and/or standoffs 124*a-i* may be utilized in some embodiments. According to some embodiments, one or more of the various components 102, 104*a-d*, 106, 108, 108-1, 108-2, 110, 110-1, 110-2, 110-3, 112, 114, 116, 118, 120, 120-1, 120-2, 122, 124*a-i*, 126, 126-1, 126-2, 128, 128-1, 130 may not be needed and/or desired in the nesting product packaging system 100.

Figure 2A:
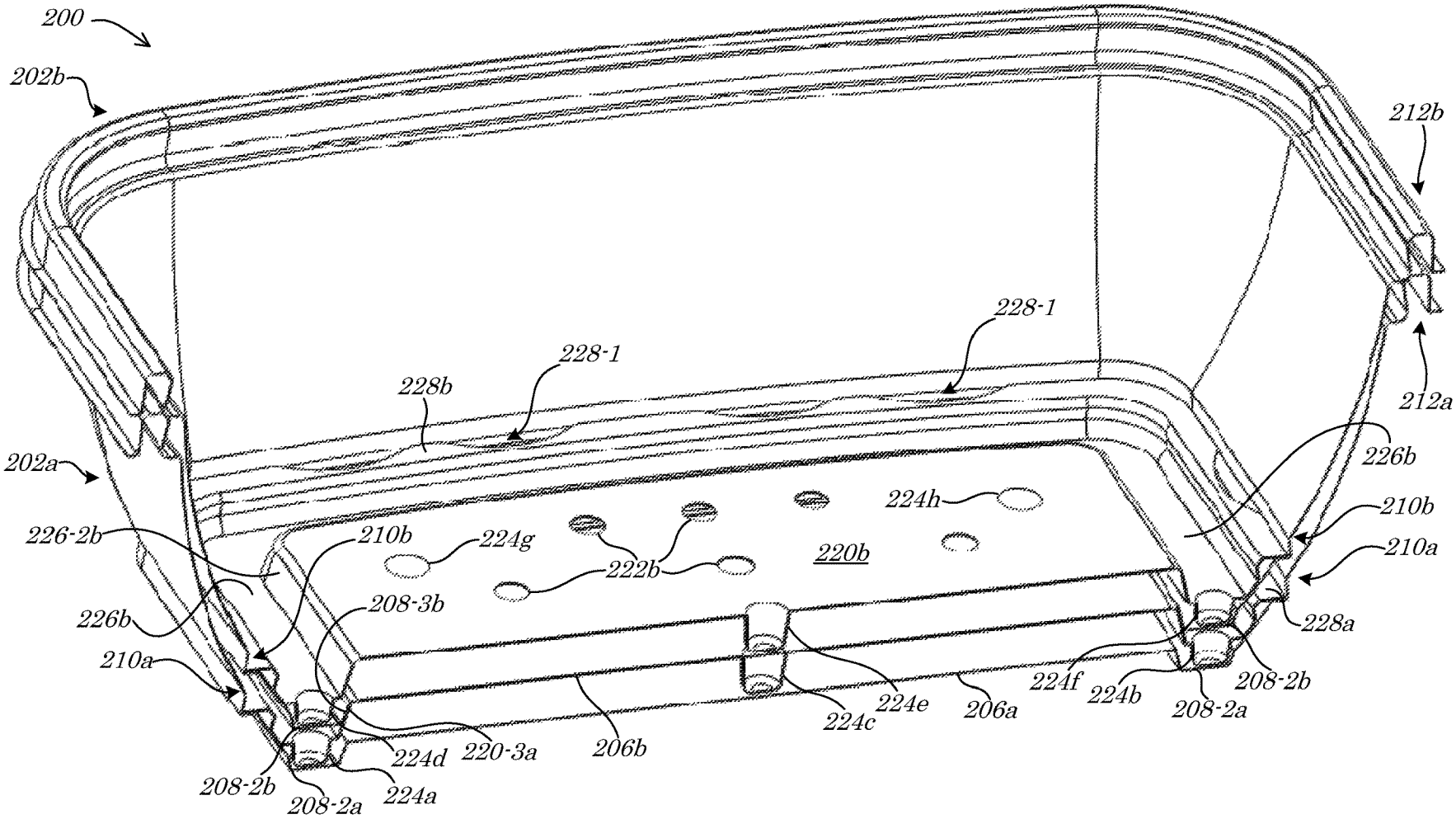
FIG. 2A and FIG. 2B are perspective cross-sectional and cross-sectional views of a nesting product packaging system according to some embodiments.
Figure 2B:
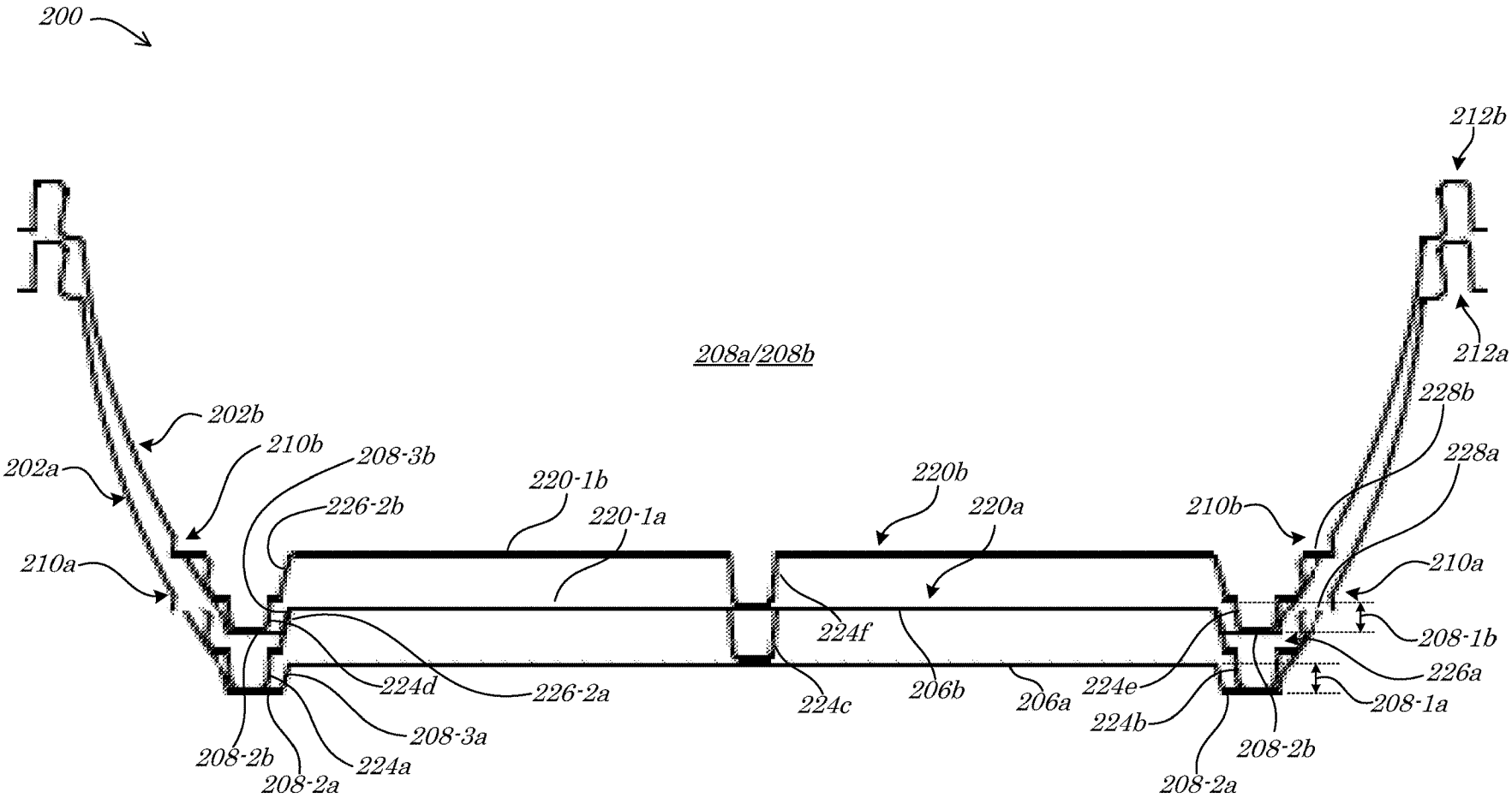
Figure 3A:
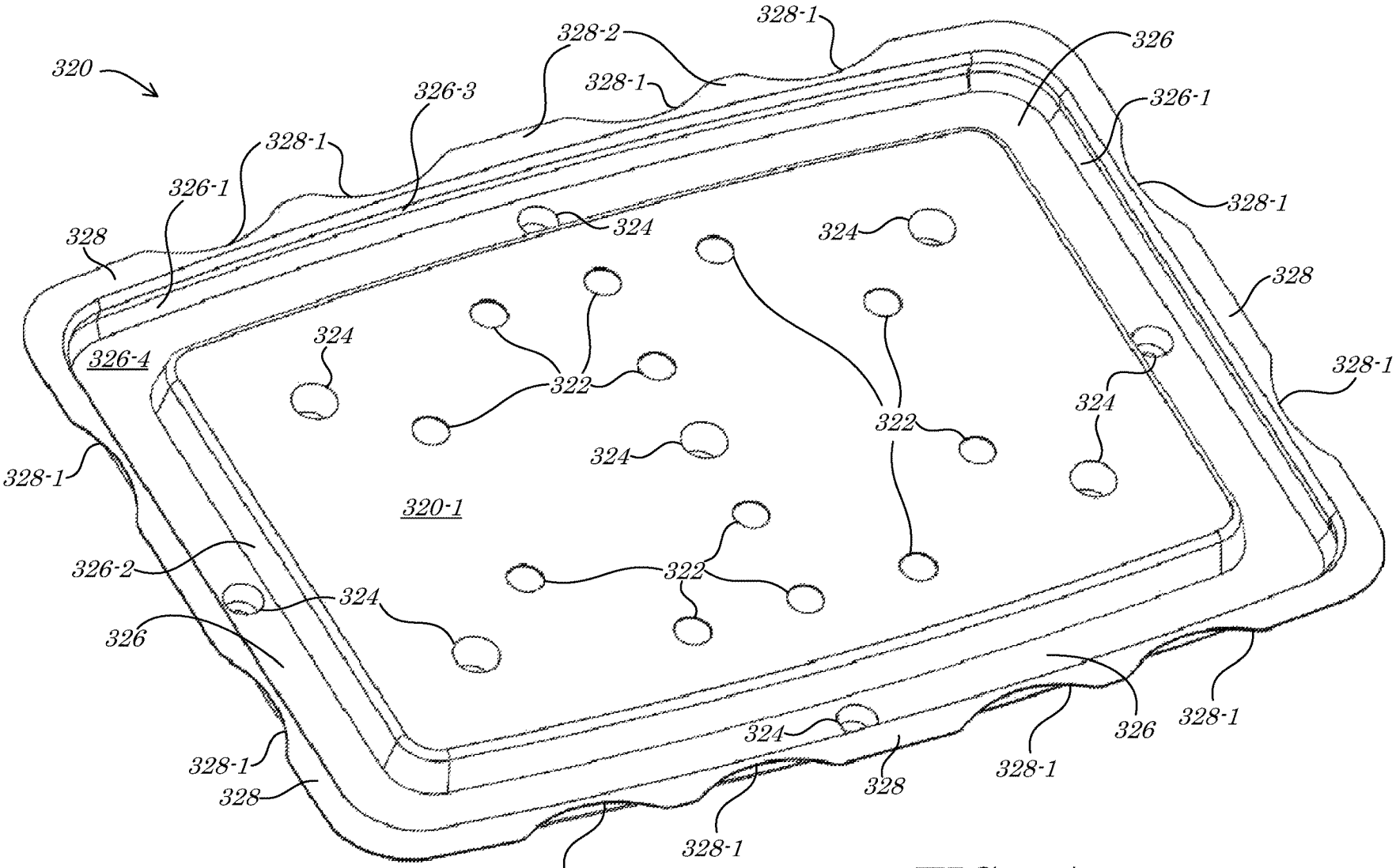
FIG. 3A, FIG. 3B, FIG. 3C, FIG. 3D, FIG. 3E, FIG. 3F, and FIG. 3G, are perspective, top, bottom, front, back, left, and right views of a nesting product packaging system insert according to some embodiments.
Figure 3B:
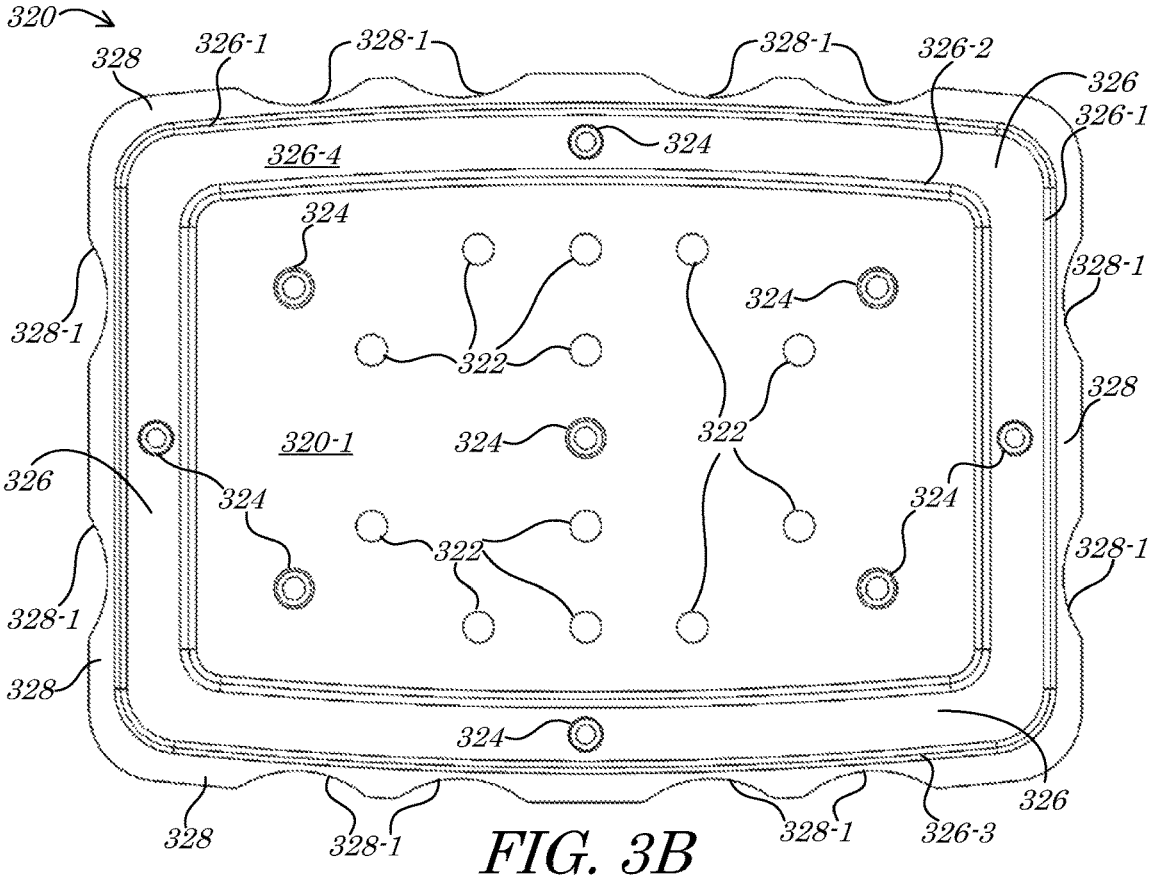
Figure 3C:
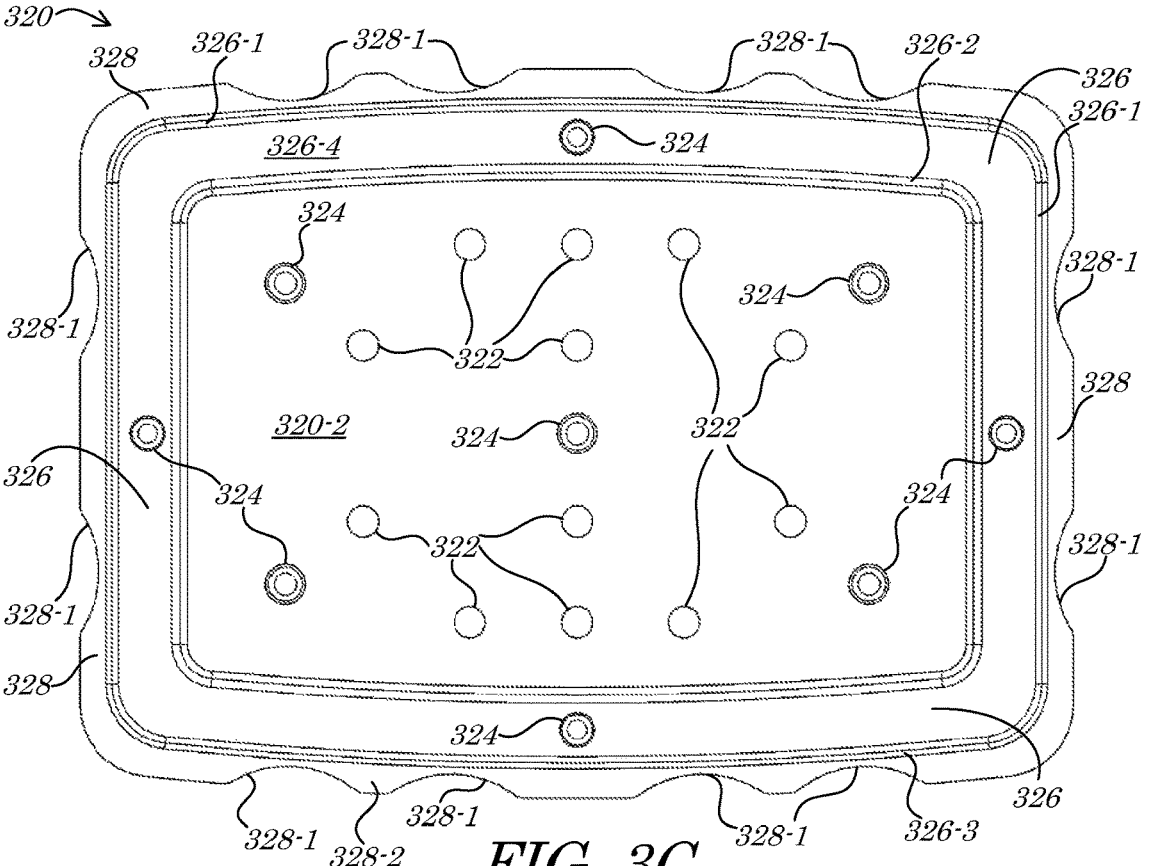
Figure 3D:
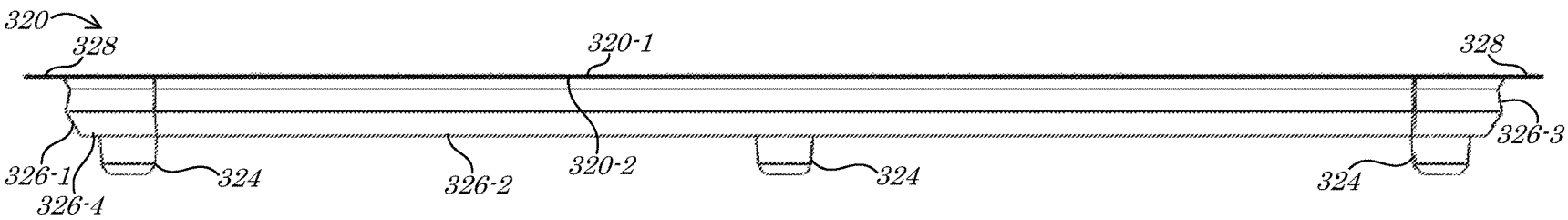
Figure 3E:
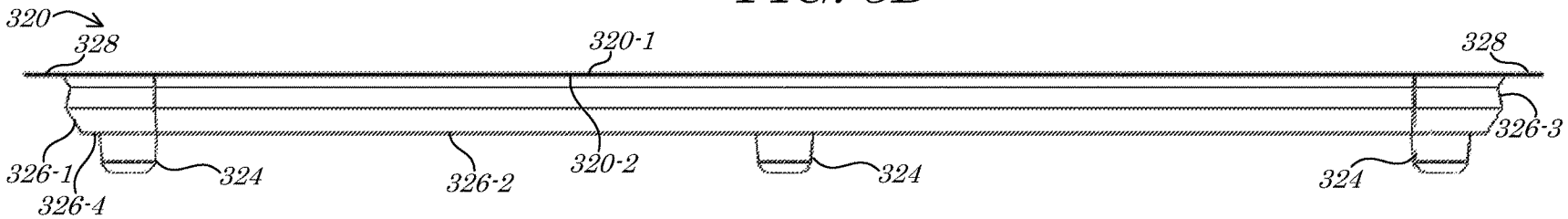
Figure 3F:
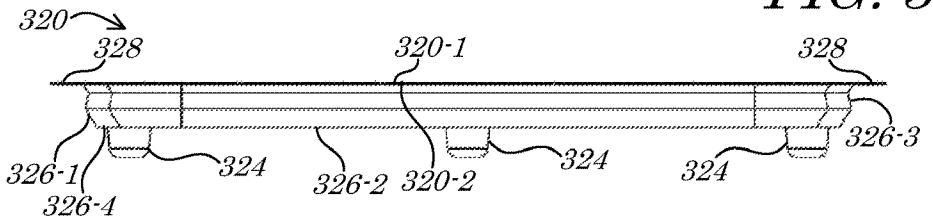
Figure 3G:
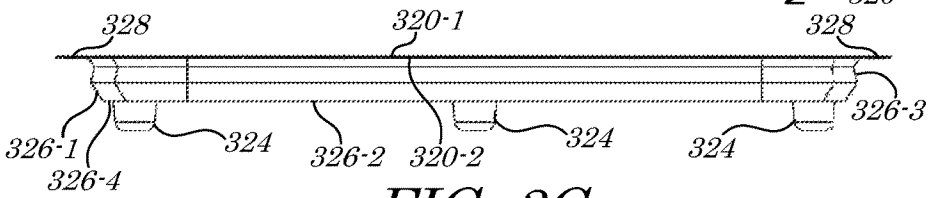

Referring now to FIG. 2A and FIG. 2B, perspective cross-sectional and cross-sectional views of a nesting product packaging system 200 according to some embodiments are shown. In some embodiments, the nesting product packaging system 200 may be similar to the system 100 of FIG. 1A, FIG. 1B, FIG. 1C, FIG. 1D, FIG. 1E, FIG. 1F, FIG. 1G, FIG. 1H, and FIG. 1I herein. The nesting product packaging system 200 may comprise, for example, a plurality of stacked and/or nested product containers 202*a-b*. As depicted, a second or upper container 202*b* may be stacked on and/or nested within a first or lower container 202*a*. According to some embodiments, each container 202*a-b* may comprise a bottom 206*a-b* and define an interior volume 208*a-b*. As depicted in the stacked/nested configuration of FIG. 2A and FIG. 2B, the second container 202*b* is disposed to occupy and/or coincide with substantially all of a first container volume 208*a* of the first container 202*a*. In such a manner, for example, storage, shipping, and/or handling costs associated with the containers 202*a-b* may be reduced by permitting the containers 202*a-b* to occupy a small amount of space (e.g., more containers 202*a-b* may be stored and/or shipped in a box or crate of a given size due to the efficiency of the nesting configuration).

In some embodiments, the container volumes 208*a-b* may comprise perimeter channels 208-1*a*, 208-1*b* that comprise and/or define respective channel bottoms 208-2*a*, 208-2*b* that extend outwardly and/or lower than the respective container bottoms 206*a-b*. According to some embodiments, the perimeter channels 208-1*a*, 208-1*b* may comprise and/or define an outer channel surface 208-3*a*, 208-3*b* such as extends between the container bottoms 206*a-b* and the respective channel bottoms 208-2*a*, 208-2*b*. In some embodiments, the containers 202*a-b* may comprise respective strainer detents 210*a-b* disposed and/or formed thereon. The container detents 210*a-b* may comprise, for example, one or more channels, guides, detents, holes, creases, folds, valleys, depressions, and/or other features that are or become known and/or practicable. According to some embodiments, the containers 202*a-b* may comprise one or more mounting rims 212*a-b* such as the continuous perimeter flange features depicted in FIG. 2A and FIG. 2B, for coupling to and/or accepting lids (not shown; e.g., the lid 114 FIG. 1A, FIG. 1B, FIG. 1C, FIG. 1D, FIG. 1E, FIG. 1F, FIG. 1G, FIG. 1H, and FIG. 1I herein).

According to some embodiments, each container 202*a-b* may comprise, house, hold, carry, and/or otherwise be coupled to a respective strainer insert 220*a-b*. In other words, containers 202*a-b* with installed strainer inserts 220*a-b* may be advantageously nested together to reduce nesting pitch which permits more strainer inserts 220*a-b* to be nested together for storage and/or transport in smaller spaces, which in turn reduces costs while providing containers 202*a-b* that are capable of extending product shelf-life by separating the product from product juices/fluids. In some embodiments, each strainer insert 220*a-b* may comprise and/or define an upper strainer surface 220-1*a*, 220-1*b* within which are disposed a plurality of respective drain holes 222 (with only those drain holes 222 of the second strainer insert 220*b* being visible in FIG. 2A). According to some embodiments, each strainer insert 220*a-b* may comprise a plurality of feet or standoffs 224*a-h*. As depicted, the standoffs 224*a-h* may generally rest upon the bottom 206*a-b* of the container 202*a-b* and/or the drain channel bottom 208-2*a*, 208-2*b* in which they are disposed. According to some embodiments, the standoffs 224*a-h* may provide support that allows the strainer insert s220*a-b* to resist deflection when loaded with product (not shown), allowing for the strainer inserts 220*a* to be constructed of a lower gauge material (e.g., thinner material) than would otherwise be required to maintain the product above any juices.

In some embodiments, each strainer insert 220*a-b* may comprise a nesting pitch reduction channel 226*a-b*, e.g., generally disposed to be positioned over the respective perimeter channel 208-1*a*, 208-1*b* of the container 202*a-b* in which they are disposed. According to some embodiments, each nesting pitch reduction channel 226*a-b* may comprise an inner bevel 226-2*a*, 226-2*b*. The inner bevels 226-2*a*, 226-2*b* may, for example, comprise portions of the strainer inserts 220*a-b* that extend downward and outwardly from the upper strainer surfaces 220-1*a*, 220-1*b* to form an inner side wall of the respective nesting pitch reduction channels 226*a-b*. According to some embodiments, a first inner bevel 226-2*a* of the first strainer insert 220*a* coupled within the first container 220*a* may support and/or nest with a corresponding outer channel surface 208-3*b* of the second container 202*b*. In such a manner, for example, the strainer inserts 220*a-b* may be configured to nest and/or couple with the bottoms 206*a-b* of nested containers 202*a-b*. In some embodiments, each strainer insert 220*a-b* may comprise a perimeter flange 228*a-b* for mounting and/or coupling to the respective strainer detents 210*a-b* and/or a plurality of cutouts 228-1 (with only those cutouts 228-1 of the second strainer insert 220*b* being visible in FIG. 2A) to provide for snap-in mounting of the perimeter flange 228*a-b* into the respective strainer detents 210*a-b* and/or to provide access to the underneath of the perimeter flange 228*a-b* so that the strainer inserts 220*a-b* may be more readily removed from the containers 202*a-b*, if desired.

In some embodiments, any or all of the components 202*a-b*, 206*a-b*, 208*a-b*, 208-1*a*, 208-1*b*, 208-2*a*, 208-2*b*, 208-3*a*, 208-3*b*, 210*a-b*, 212*a-b*, 220*a-b*, 220-1*a*, 220-1*b*, 222, 224*a-h*, 226*a-b*, 226-2*a*, 226-2*b*, 228*a-b*, 228-1 of the nesting product packaging system 200 may be similar in configuration and/or functionality to any similarly named and/or numbered components described herein. Fewer or more components 202*a-b*, 206*a-b*, 208*a-b*, 208-1*a*, 208-1*b*, 208-2*a*, 208-2*b*, 208-3*a*, 208-3*b*, 210*a-b*, 212*a-b*, 220*a-b*, 220-1*a*, 220-1*b*, 222, 224*a-h*, 226*a-b*, 226-2*a*, 226-2*b*, 228*a-b*, 228-1 (and/or portions thereof) and/or various configurations of the components 202*a-b*, 206*a-b*, 208*a-b*, 208-1*a*, 208-1*b*, 208-2*a*, 208-2*b*, 208-3*a*, 208-3*b*, 210*a-b*, 212*a-b*, 220*a-b*, 220-1*a*, 220-1*b*, 222, 224*a-h*, 226*a-b*, 226-2*a*, 226-2*b*, 228*a-b*, 228-1 may be included in the nesting product packaging system 200 without deviating from the scope of embodiments described herein. According to some embodiments, one or more of the various components 202*a-b*, 206*a-b*, 208*a-b*, 208-1*a*, 208-1*b*, 208-2*a*, 208-2*b*, 208-3*a*, 208-3*b*, 210*a-b*, 212*a-b*, 220*a-b*, 220-1*a*, 220-1*b*, 222, 224*a-h*, 226*a-b*, 226-2*a*, 226-2*b*, 228*a-b*, 228-1 may not be needed and/or desired in the nesting product packaging system 200.

Turning now to FIG. 3A, FIG. 3B, FIG. 3C, FIG. 3D, FIG. 3E, FIG. 3F, and FIG. 3G, perspective, top, bottom, front, back, left, and right views of a nesting product packaging system insert 320 according to some embodiments are shown. In some embodiments, the nesting product packaging system insert 320 may be similar in configuration to the strainer inserts 120, 220*a-b* of the systems 100, 200 of FIG. 1A, FIG. 1B, FIG. 1C, FIG. 1D, FIG. 1E, FIG. 1F, FIG. 1G, FIG. 1H, FIG. 1I, FIG. 2A, and/or FIG. 2B herein. The nesting product packaging system insert 320 may comprise and/or define, for example, an upper insert surface 320-1 that may be disposed along a plane (e.g., a horizontal plane, for ease of reference). According to some embodiments, the nesting product packaging system insert 320 may comprise a plastic (e.g., PET) and/or other thin flexible material also comprising and/or defining a lower insert surface 320-2 underneath and facing in the opposite direction of the upper insert surface 320-1. In some embodiments, the nesting product packaging system insert 320 may be constructed of PET material with a thickness in the range of eight to twelve mils (8-12 mils). In such a manner for example, the nesting product packaging system insert 320 may be advantageously constructed utilizing thinner PET material than is typically utilized for product containers (not shown; e.g., the containers 102, 202*a-b* of the systems 100, 200 of FIG. 1A, FIG. 1B, FIG. 1C, FIG. 1D, FIG. 1E, FIG. 1F, FIG. 1G, FIG. 1H, FIG. 1I, FIG. 2A, and/or FIG. 2B herein), which reduces cost and reduces the amount of material that needs to be recycled. According to some embodiments, the nesting product packaging system insert 320 may comprise a plurality of drain holes 322 disposed and/or formed through both of the upper insert surface 320-1 and the lower insert surface 320-2. While certain quantities, sizes, shapes, and configurations of drain holes 322 are depicted for exemplary purposes, in some embodiments different quantities, sizes, shapes, and/or configurations of drain holes 322 may be utilized in the nesting product packaging system insert 320, e.g., to promote different quantities and/or types of drainage for different products (not shown) that may be stored upon the upper insert surface 320-1.

In some embodiments, the nesting product packaging system insert 320 may comprise a plurality of feet or standoffs 324. The standoffs 324 may, for example, comprise cylindrical or frustoconical projections extending outwardly (e.g., downwardly) from the upper insert surface 320-1 and/or the lower insert surface 320-2. According to some embodiments, the standoffs 324 may provide support for product disposed on the upper insert surface 320-2 such that the nesting product packaging system insert 320 may be constructed of thin and/or pliable material but still support the product without collapsing. The standoffs 324 may accordingly, in some embodiments, maintain a separation of the product from any juices that drain through the drain holes 322 and are resident beneath the nesting product packaging system insert 320 (e.g., during operation—such as once installed in a product container).

According to some embodiments, the nesting product packaging system insert 320 may comprise a nesting pitch reduction channel 326 or "moat" surrounding the extents of the upper insert surface 320-1. According to some embodiments, the nesting pitch reduction channel 326 may comprise a first side wall or outer nesting surface 326-1 at an outer extent of the nesting pitch reduction channel 326 and/or a second side wall or inner bevel 326-2 at an inner extent of the drain channel 326. In some embodiments, the nesting pitch reduction channel 326 and/or the first side wall thereof may comprise a de-nesting feature 326-3 coupled to and/or formed on an upper surface or edge of the outer nesting surface 326-1. According to some embodiments, and as best viewed in FIG. 3D, FIG. 3E, FIG. 3F, and FIG. 3G, the outer nesting surface 326-1 may be angled outwardly while the de-nesting feature 326-3 may comprise a surface angled inwardly, forming an outwardly protruding vertex at the junction of the outer nesting surface 326-1 and the de-nesting feature 326-3. In some embodiments, the side walls (e.g., the de-nesting feature 326-3 and the outer nesting surface 326-1 on one side and the inner bevel 326-2 on the opposing side) may be coupled to and/or connected by a channel bottom 326-4 that is disposed at a lower elevation than the upper insert surface 320-1 (and/or the lower insert surface 320-2).

According to some embodiments, the inner bevel 326-2 may connect the channel bottom 326-4 to the upper insert surface 320-1 while the de-nesting feature 326-3 and the outer nesting surface 326-1 may connect the channel bottom 326-4 to a perimeter flange 328. The perimeter flange 328 may comprise a planar extension of the nesting product packaging system insert 320, for example, that is configured to mate with a corresponding detent, channel, groove, hole, or other feature of a product container, thereby coupling the nesting product packaging system insert 320 to the container at a desired position and/or orientation. In some embodiments, the perimeter flange 328 may comprise a plurality of cutouts 328-1 along the length thereof, such cutouts defining portions of the perimeter flange 328 that protrude from the nesting product packaging system insert 320 by a greater distance than other adjacent portions of the perimeter flange 328. These protrusions may, in some embodiments, comprise tabs 328-2 that are configured to mate with a corresponding feature of a product container and/or are configured to be flexible. The tabs 328-2 may, for example, be selectively bent or elastically distorted to allow for the tabs 328-2 to be inserted into a mating feature, with the tabs 328-2 returning to their normal unbent or undistorted configuration once inserted, such that they lock the nesting product packaging system insert 320 into a desired position within the container. In the case that it is desirable to remove the nesting product packaging system insert 320 from the container, the tabs 328-2 may once again be bent or distorted to allow a disengagement with the mating feature to cause an unlocking or uncoupling of the nesting product packaging system insert 320 from the container.

In some embodiments, any or all of the components 320-1, 320-2, 322, 324, 326, 326-1, 326-2, 326-3, 326-4, 328, 328-1, 328-2 of the nesting product packaging system insert 300 may be similar in configuration and/or functionality to any similarly named and/or numbered components described herein. Fewer or more components 320-1, 320-2, 322, 324, 326, 326-1, 326-2, 326-3, 326-4, 328, 328-1, 328-2 (and/or portions thereof) and/or various configurations of the components 320-1, 320-2, 322, 324, 326, 326-1, 326-2, 326-3, 326-4, 328, 328-1, 328-2 may be included in the nesting product packaging system insert 300 without deviating from the scope of embodiments described herein. According to some embodiments, one or more of the various components 320-1, 320-2, 322, 324, 326, 326-1, 326-2, 326-3, 326-4, 328, 328-1, 328-2 may not be needed and/or desired in the nesting product packaging system insert 300.

Figure 4A:
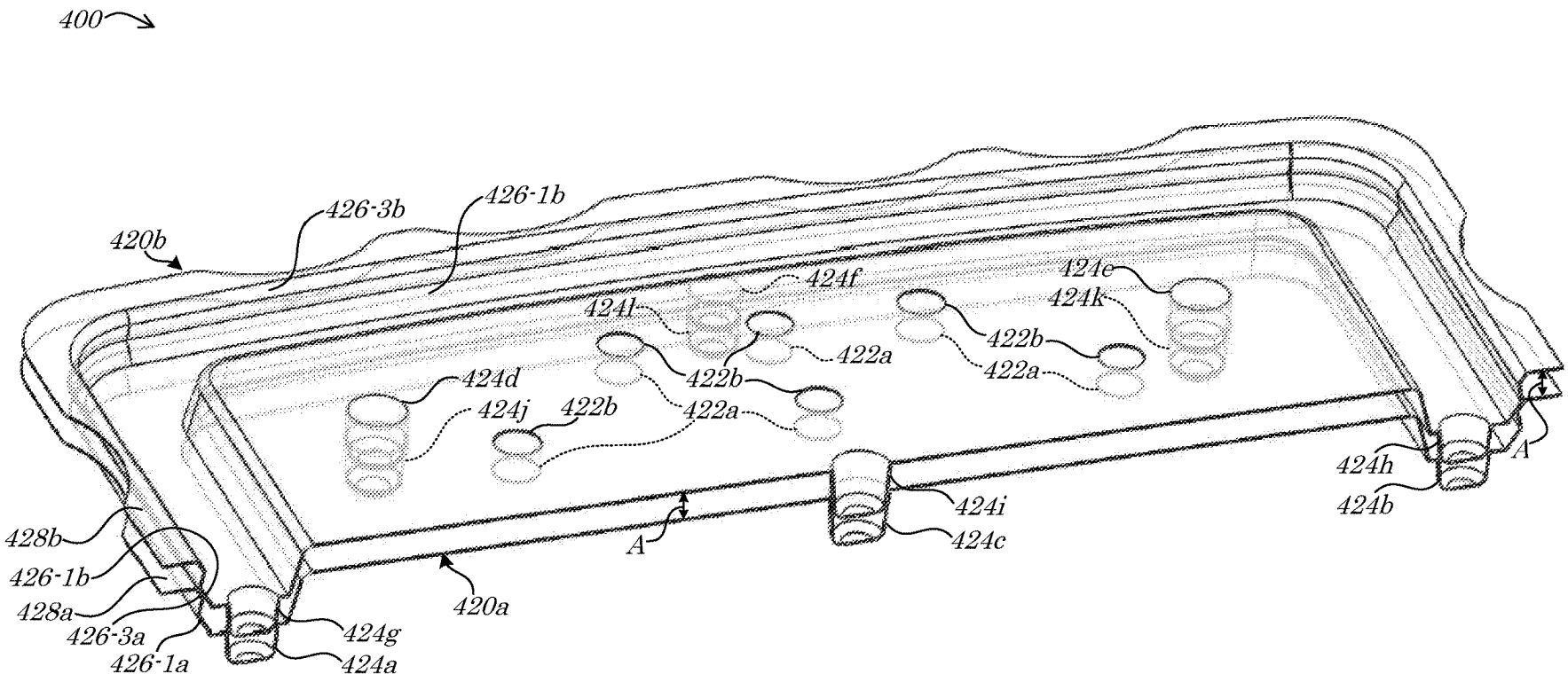
FIG. 4A and FIG. 4B are perspective cross-sectional and cross-sectional views of a nesting product packaging system according to some embodiments.
Figure 4B:
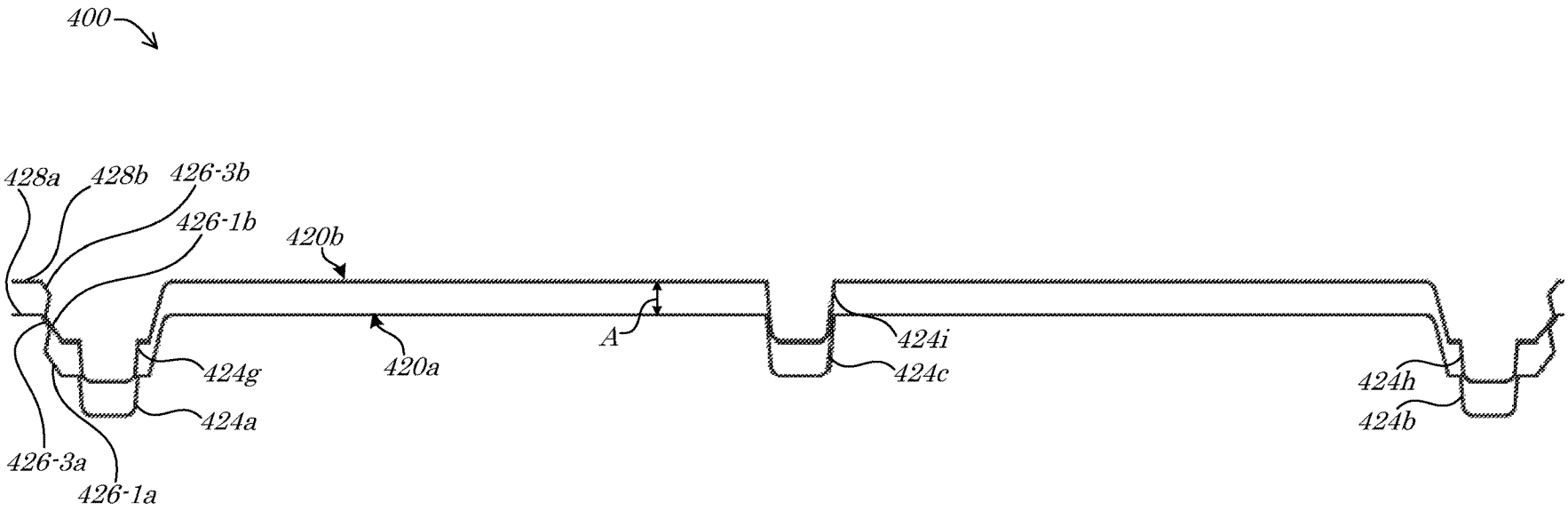

Referring now to FIG. 4A and FIG. 4B, perspective cross-sectional and cross-sectional views of a nesting product packaging system 400 according to some embodiments are shown. In some embodiments, the nesting product packaging system 400 may comprise a plurality of stacked and/or nested strainer inserts 420*a-b*. According to some embodiments, the strainer inserts 420*a-b* may be similar in configuration to the strainer inserts 120, 220*a-b*, 320 of the systems 100, 200, 320 of FIG. 1A, FIG. 1B, FIG. 1C, FIG. 1D, FIG. 1E, FIG. 1F, FIG. 1G, FIG. 1H, FIG. 1I, FIG. 2A, FIG. 2B, FIG. 3A, FIG. 3B, FIG. 3C, FIG. 3D, FIG. 3E, FIG. 3F, and/or FIG. 3G herein. According to some embodiments, a second strainer insert 420*b* may be stacked upon and/or nested with a first strainer insert 420*a*. In some embodiments, the first strainer insert 420*a* may comprise a plurality of drain holes 422*a* and/or the second strainer insert 420*b* may comprise a plurality of drain holes 422*b*. According to some embodiments, the strainer inserts 420*a-b* may comprise a plurality of standoffs 424*a*-1. The standoffs 424*a*-1 may comprise, for example, cylindrical, conical, frustoconical, square, rectangular, and/or other geometric protrusions emanating from the underside of each respective strainer insert 420*a-b*.

In some embodiments, some or all of the standoffs 424*a*-1 may be vertically aligned such that they form nested pairs in the case that the strainer inserts 420*a-b* are nested, as shown. For example: (i) a seventh standoff 424*g* of the second strainer insert 420*b* may nest with a first standoff 424*a* of the first strainer insert 420*a*, (ii) an eighth standoff 424*i* of the second strainer insert 420*b* may nest with a third standoff 424*c* of the first strainer insert 420*a*, (iii) a ninth standoff 424*h* of the second strainer insert 420*b* may nest with a second standoff 424*b* of the first strainer insert 420*a*, (iv) a tenth standoff 424*j* of the second strainer insert 420*b* may nest with a fourth standoff 424*d* of the first strainer insert 420*a*, (v) a twelfth standoff 4241 of the second strainer insert 420*b* may nest with a sixth standoff 424*f* of the first strainer insert 420*a*, and/or (vi) an eleventh standoff 424*k* of the second strainer insert 420*b* may nest with a fifth standoff 424*e* of the first strainer insert 420*a*. In some embodiments, the standoffs 424*a*-1 may be formed with a taper and/or exterior flange, bump, or other feature that prevents a nested standoff 424*g*-1 from fully embedding within the corresponding parent or lower standoff 424*a-f*. In such a manner, for example, distance "A" (e.g., nesting pitch) may be maintained between the stacked/nested strainer inserts 420*a-b*, facilitating decoupling, de-nesting, and/or unstacking of the strainer inserts 420*a-b* by allowing space (e.g., "A") to access in between the strainer inserts 420*a-b* to cause separation thereof.

According to some embodiments, the strainer inserts 426*a-b* may comprise outer nesting surfaces 426-1*a*, 426-1*b* that are oriented and/or configured to align with de-nesting features 426-3*a*, 426-3*b* of adjacent stacked/nested strainer inserts 420*a-b*. As best viewed in FIG. 4B, for example, a second outer nesting surface 426-1*b* of the second strainer insert 420*b* may comprise an outwardly angled surface that aligns with an outwardly angled first de-nesting feature 426-3*a* of the first strainer insert 420*a*. In such a manner, for example, the strainer inserts 420*a-b* may be prevented from fully nesting (e.g., in the case that the standoffs 424*a*-1 are not configured to limit nesting distance) in the case that the second outer nesting surface 426-1*b* of the second strainer insert 420*b* is urged to rest against the first de-nesting feature 426-3*a* of the first strainer insert 420*a*. The first de-nesting feature 426-3*a* of the first strainer insert 420*a* may, for example, prevent the second strainer insert 420*b* from nesting any closer or tighter to the first strainer insert 420*a* than the distance "A". According to some embodiments, the standoffs 424*a*-1 and/or the de-nesting features 426-3*a*, 426-3*b* and the outer nesting surfaces 426-1*a*, 426-lb may be sized and/or positioned to achieve the distance "A" as is or becomes desirable.

In some embodiments, the distance "A" may also or alternatively be maintained between perimeter flanges 428*a-b* of the strainer inserts 420*a-b*. In such a manner, for example, a human and/or machine (neither of which is shown) may readily gain access at the perimeters of the strainer inserts 420*a-b* to access the space in between to cause separation of the strainer inserts 420*a-b*. In some embodiments, the distance "A" may be configured such that a human digit may be inserted into the space between the strainer inserts 420*a-b* to force the strainer inserts 420*a-b* apart. The distance "A" may permit, for example, any desirable object to be inserted between the strainer inserts 420*a-b* such that upward force is applied to the underside of the second perimeter flange 428*b* and downward force is applied to the topside of the first perimeter flange 428*a*, thereby urging the perimeter flanges 428*a-b* (and the corresponding strainer inserts 420*a-b*) apart.

In some embodiments, any or all of the components 420*a-b*, 422*a-b*, 424*a*-1, 426-1*a*, 426-1*b*, 426-3*a*, 426-3*b*, 428*a-b* of the nesting product packaging system 400 may be similar in configuration and/or functionality to any similarly named and/or numbered components described herein. Fewer or more components 420*a-b*, 422*a-b*, 424*a*-1, 426-1*a*, 426-1*b*, 426-3*a*, 426-3*b*, 428*a-b* (and/or portions thereof) and/or various configurations of the components 420*a-b*, 422*a-b*, 424*a*-1, 426-1*a*, 426-1*b*, 426-3*a*, 426-3*b*, 428*a-b* may be included in the nesting product packaging system 400 without deviating from the scope of embodiments described herein. According to some embodiments, one or more of the various components 420*a-b*, 422*a-b*, 424*a*-1, 426-1*a*, 426-1*b*, 426-3*a*, 426-3*b*, 428*a-b* may not be needed and/or desired in the nesting product packaging system 400.

III. Methods For Nesting Product Packaging With Strainer Inserts

Various embodiments herein may be carried out and/or effectuated by execution of one or more methods and/or procedures. Any processes, methods, and/or associated process diagrams and flow diagrams described and/or depicted herein do not necessarily imply a fixed order to any described actions, steps, and/or procedures, and embodiments may generally be performed in any order that is practicable unless otherwise and specifically noted. While the order of actions, steps, and/or procedures described herein is generally not fixed, in some embodiments, actions, steps, and/or procedures may be specifically performed in the order listed, depicted, and/or described and/or may be performed in response to any previously listed, depicted, and/or described action, step, and/or procedure. Any of the processes and methods described herein may be performed and/or facilitated by hardware, software (including microcode), firmware, or any combination thereof. For example, a storage medium (e.g., a hard disk, Random Access Memory (RAM) device, cache memory device, Universal Serial Bus (USB) mass storage device, and/or Digital Video Disk (DVD); e.g., the memory device 540 of FIG. 5 herein) may store thereon instructions that when executed by a machine (such as a thermoplastic manufacturing, nesting, and/or product stacking machine) result in performance according to any one or more of the embodiments described herein.

In some embodiments, a method may comprise manufacturing one or more of a strainer insert and a product container. Strainer inserts and/or product containers may be extruded and/or otherwise formed from sheets of raw materials such as sheets of PET, for example, fed into thermoplastic forming machines. According to some embodiments, the manufacturing machine(s) may form the strainer inserts and/or product containers in accordance with the configurations and features described herein. In some embodiments, the method may comprise parallel processes such as forming of strainer inserts from a first material having a first thickness and also forming the product containers from a second material having a second thickness. According to some embodiments, once the strainer inserts are formed they may be subjected to hole punching to form and/or define any drain holes that are desired. In some embodiments, the strainer inserts may be trimmed to the appropriate dimensions and geometries and separated from the sheet of material and/or from each other. According to some embodiments, the strainer inserts may be nested or stacked together for shipping, storage, and/or assembly staging.

According to some embodiments, the product containers may be formed and a strainer insert (e.g., retrieved from a staging area and/or device) may be inserted into each formed container. In some embodiments, the product containers may be trimmed to the appropriate dimensions and geometries and separated from the sheet of material and/or from each other. According to some embodiments, the product packaging systems (e.g., the product containers with strainer inserts coupled therein) may then be stacked for shipping, storage, and/or staging. In some embodiments, stacked and/or staged product packaging systems in accordance with the descriptions herein may be utilized to package various products that may be desirable to maintain separately from any liquids. As described herein, for example, each product packaging system may be packed with produce and/or fresh-cut fruit and sealed with an appropriate lid. The product packaged in each product packaging system may be advantageously separated from any juices or other fluids in the product container by the strainer inserts in accordance with embodiments described herein. In such a manner, product shelf life may be extended in a manner that reduces manufacturing, shipping, packaging, and/or distribution costs. According to some embodiments, these and other processes involving the product packaging systems described herein may be effectuated by one or more machine and/or computer systems, e.g., in an automated fashion (e.g., without human intervention).

Figure 5:
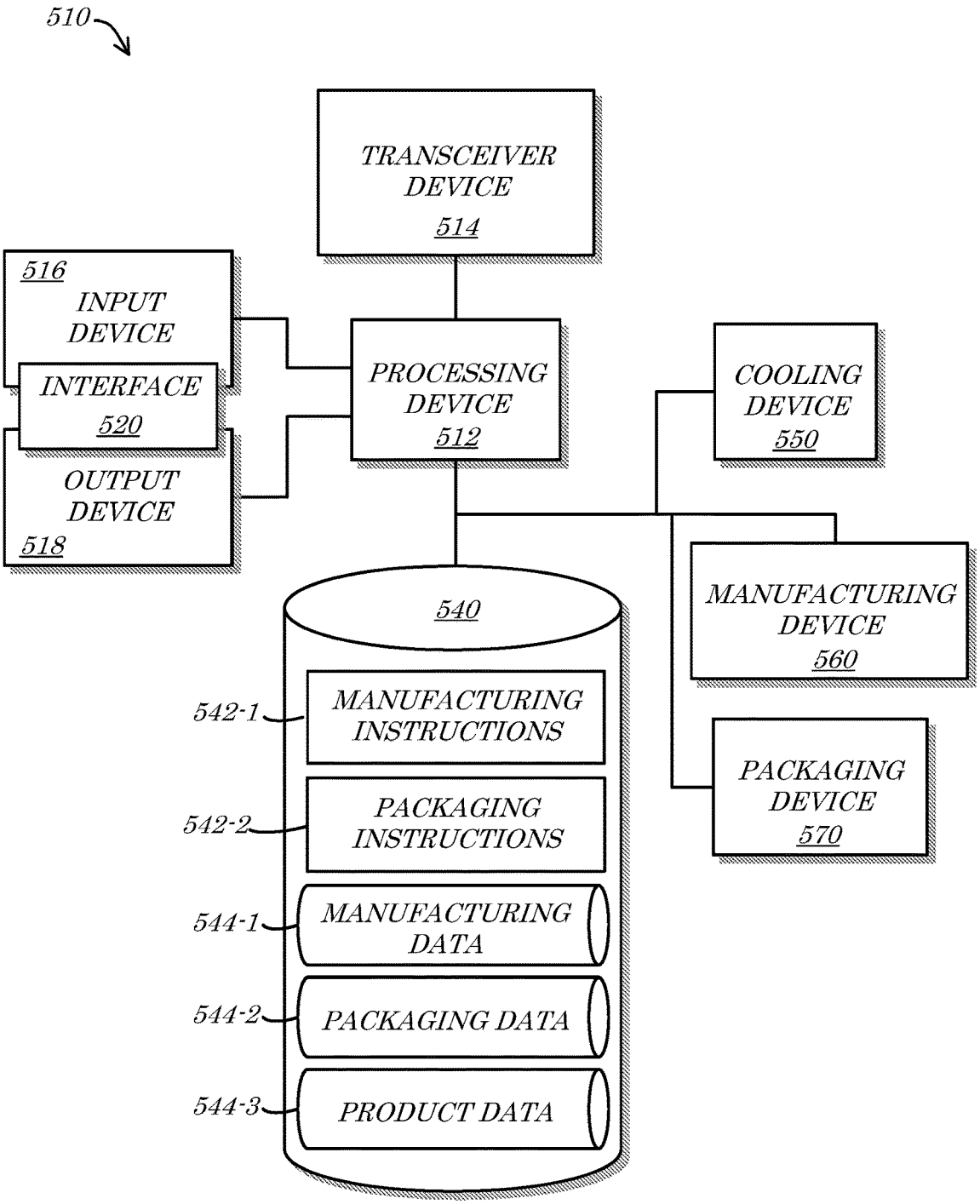
FIG. 5 is a block diagram of a system according to some embodiments.

Turning to FIG. 5 for example, a block diagram of a machine and/or computerized system 510 according to some embodiments is shown. In some embodiments, the computerized system 510 may execute, process, facilitate, and/or otherwise be associated with the methods and/or processes described herein, and/or portions thereof. In some embodiments, the computerized system 510 may comprise a processing device 512, a transceiver device 514, an input device 516, an output device 518, an interface 520, a memory device 540 (storing various programs and/or instructions 542 and data 544), a cooling device 550, a manufacturing device 560, and/or a packaging device 570. Fewer or more components 512, 514, 516, 518, 520, 540, 542, 544, 550, 560, 570 and/or various configurations of the components 512, 514, 516, 518, 520, 540, 542, 544, 550, 560, 570 be included in the computerized system 510 without deviating from the scope of embodiments described herein.

According to some embodiments, the processing device 512 may be or include any type, quantity, and/or configuration of processor that is or becomes known. The processing device 512 may comprise, for example, an Intel® IXP 2800 network processor or an Intel® XEON™ Processor coupled with an Intel® E6501 chipset. In some embodiments, the processing device 512 may comprise multiple inter-connected processors, microprocessors, and/or micro-engines. According to some embodiments, the processing device 512 (and/or the computerized system 510 and/or other components thereof) may be supplied power via a power supply (not shown), such as a battery, an Alternating Current (AC) source, a Direct Current (DC) source, an AC/DC adapter, solar cells, and/or an inertial generator. In the case that the computerized system 510 comprises a server, such as a blade server, necessary power may be supplied via a standard AC outlet, power strip, surge protector, and/or Uninterruptible Power Supply (UPS) device.

In some embodiments, the transceiver device 514 may comprise any type or configuration of communication device that is or becomes known or practicable. The transceiver device 514 may, for example, comprise a Network Interface Card (NIC), a telephonic device, a cellular network device, a router, a hub, a modem, and/or a communications port or cable. According to some embodiments, the transceiver device 514 may also or alternatively be coupled to the processing device 512. In some embodiments, the transceiver device 514 may comprise an IR, RF, Bluetooth™, Near-Field Communication (NFC), and/or Wi-Fi® network device coupled to facilitate communications between the processing device 512 and the manufacturing device 560, the packaging device 570, and/or another device (not shown).

According to some embodiments, the input device 516 and/or the output device 518 may be communicatively coupled to the processing device 512 (e.g., via wired and/or wireless connections and/or pathways) and they may generally comprise any types or configurations of input and output components and/or devices that are or become known, respectively. The input device 516 may comprise, for example, a keyboard that allows an operator of the computerized system 510 to interface with the computerized system 510 (e.g., a manufacturing and/or packaging assembly line operator). The output device 518 may, according to some embodiments, comprise a display screen and/or other practicable output component and/or device. The output device 518 may, for example, provide an interface via which the computerized system 510 may be operated and/or controlled. According to some embodiments, the input device 516 and/or the output device 518 may comprise and/or be embodied in a single device, such as a touch-screen monitor or display.

The memory device 540 may comprise any appropriate information storage device that is or becomes known or available, including, but not limited to, units and/or combinations of magnetic storage devices (e.g., a hard disk drive), optical storage devices, and/or semiconductor memory devices, such as RAM devices, Read Only Memory (ROM) devices, Single Data Rate Random Access Memory (SDR-RAM), Double Data Rate Random Access Memory (DDR-RAM), and/or Programmable Read Only Memory (PROM). The memory device 540 may, according to some embodiments, store one or more of manufacturing instructions 542-1, packaging instructions 542-2, manufacturing data 544-1, packaging data 544-2, and/or product data 544-3. In some embodiments, the manufacturing instructions 542-1, packaging instructions 542-2, manufacturing data 544-1, packaging data 544-2, and/or product data 544-3 may be utilized by the processing device 512 to provide output information via the output device 518 and/or the transceiver device 514.

According to some embodiments, the manufacturing instructions 542-1 may be operable to cause the processing device 512 to process manufacturing data 544-1, packaging data 544-2, and/or product data 544-3 in accordance with embodiments as described herein. Manufacturing data 544-1, packaging data 544-2, and/or product data 544-3 received via the input device 516 and/or the transceiver device 518 may, for example, be analyzed, sorted, filtered, decoded, decompressed, ranked, scored, plotted, and/or otherwise processed by the processing device 512 in accordance with the manufacturing instructions 542-1. In some embodiments, manufacturing data 544-1, packaging data 544-2, and/or product data 544-3 may be fed by the processing device 512 through one or more mathematical and/or statistical formulas and/or models in accordance with the manufacturing instructions 542-1 to create one or more product containers, strainer inserts, and/or related components, as described herein.

In some embodiments, the packaging instructions 542-2 may be operable to cause the processing device 512 to process manufacturing data 544-1, packaging data 544-2, and/or product data 544-3 in accordance with embodiments as described herein. Manufacturing data 544-1, packaging data 544-2, and/or product data 544-3 received via the input device 516 and/or the transceiver device 518 may, for example, be analyzed, sorted, filtered, decoded, decompressed, ranked, scored, plotted, and/or otherwise processed by the processing device 512 in accordance with the packaging instructions 542-2. In some embodiments, manufacturing data 544-1, packaging data 544-2, and/or product data 544-3 may be fed by the processing device 512 through one or more mathematical and/or statistical formulas and/or models in accordance with the packaging instructions 542-2 to pack one or more products into a product container with a strainer insert, as described herein.

According to some embodiments, the computerized system 510 may comprise the cooling device 550. According to some embodiments, the cooling device 550 may be coupled (physically, thermally, and/or electrically) to the processing device 512, the memory device 540, the manufacturing device 560, and/or the packaging device 570. The cooling device 550 may, for example, comprise a fan, heat sink, heat pipe, radiator, cold plate, and/or other cooling component or device or combinations thereof, configured to remove heat from portions or components of the computerized system 510.

Any or all of the exemplary instructions and data types described herein and other practicable types of data may be stored in any number, type, and/or configuration of memory devices that is or becomes known. The memory device 540 may, for example, comprise one or more data tables or files, databases, table spaces, registers, and/or other storage structures. In some embodiments, multiple databases and/or storage structures (and/or multiple memory devices 540) may be utilized to store information associated with the computerized system 510. According to some embodiments, the memory device 540 may be incorporated into and/or otherwise coupled to the computerized system 510 (e.g., as shown) or may simply be accessible to the computerized system 510 (e.g., externally located and/or situated).

IV. Rules of Interpretation

While the description of the systems and methods herein includes references to various directions as "upward" or "downward" and "horizontal" and "vertical", embodiments are not limited to vertical or horizontal orientations and the terminology is utilized to convey relative orientations. The features depicted in the figures herein, for example, are presented in a horizontal-vertical orientation for ease of illustration only. Product packaging containers, systems, and/or strainer inserts are not always oriented horizontally, and accordingly any products therein may not be evenly distributed within and/or may not function in accordance with described embodiments in the case that acceptable product storage requirements are not maintained (e.g., juices kept separate from the product by embodiments herein may be reintroduced to the product in the case that the product container is tipped over).

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately and/or specially-programmed computers and/or computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software.

A "processor" or "processing device" generally means any one or more microprocessors, CPU devices, computing devices, microcontrollers, digital signal processors, or like devices, as further described herein.

The term "computer-readable medium" refers to any medium that participates in providing data (e.g., instructions or other information) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave, or any other medium from which a computer can read.

The term "computer-readable memory" may generally refer to a subset and/or class of computer-readable medium that does not include transmission media, such as waveforms, carrier waves, electromagnetic emissions, etc. Computer-readable memory may typically include physical media upon which data (e.g., instructions or other information) are stored, such as optical or magnetic disks and other persistent memory, DRAM, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, computer hard drives, backup tapes, Universal Serial Bus (USB) memory devices, and the like.

Various forms of computer readable media may be involved in carrying data, including sequences of instructions, to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

The present invention can be configured to work in a network environment including a computer that is in communication, via a communications network, with one or more devices. The computer may communicate with the devices directly or indirectly, via a wired or wireless medium, such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant intends to file additional applications to pursue patents for subject matter that has been disclosed and enabled but not claimed in the present application. It will be understood that various modifications can be made to the embodiments of the present disclosure herein without departing from the scope thereof. Therefore, the above description should not be construed as limiting the disclosure, but merely as embodiments thereof. Those skilled in the art will envision other modifications within the scope of the invention as defined by the claims appended hereto.

What is claimed is:

1. A nesting product packaging system, comprising:

a product container comprising (i) four sides and a bottom defining a container volume and (ii) a strainer detent formed in at least one of the four sides, the strainer detent comprising a detent sidewall defining a retention angle; and a strainer insert disposed within the container volume, the strainer insert comprising:

a horizontally disposed upper insert surface; and a perimeter flange substantially coplanar with the horizontally disposed upper insert surface:

the strainer insert defining a drainage volume between the strainer insert and the product container bottom, wherein the perimeter flange of the strainer insert is coupled to the strainer detent such that the perimeter flange is impeded from uncoupling from the strainer detent by the detent sidewall;

the strainer insert further comprising a nesting pitch reduction channel, the nesting pitch reduction channel configured to:

receive a drain channel bottom of a nested strainer insert and product container pair; and reduce a nesting pitch of the nested strainer insert and product container pair.

2. The nesting product packaging system of claim 1, further comprising:

a lid coupled to cover the container volume of the product container.

3. The nesting product packaging system of claim 1, wherein the container volume of the product container is configured to hold a product.

4. The nesting product packaging system of claim 3, wherein the product comprises a fresh-cut fruit product.

5. The nesting product packaging system of claim 3, wherein the drainage volume is configured to hold liquid that bleeds from the product.

6. The nesting product packaging system of claim 1, wherein the retention angle comprises an acute angle.

7. The nesting product packaging system of claim 1, wherein the strainer detent further comprises a detent floor and the perimeter flange comprises at least two cutouts defining a perimeter tab that rests on the detent floor and is impeded from uncoupling from the strainer detent by the detent sidewall.

8. The nesting product packaging system of claim 1, wherein the strainer insert comprises a plurality of drain holes extending therethrough.

9. The nesting product packaging system of claim 1, wherein the strainer insert comprises an inner bevel formed at an angle equivalent to an angle formed on the bottom of the product container.

10. The nesting product packaging system of claim 1, wherein the strainer insert further comprises a de-nesting feature disposed adjacent to the perimeter flange.

11. The nesting product packaging system of claim 1, comprising a plurality of standoffs protruding from an underside of the strainer.

12. The nesting product packaging system of claim 1, wherein the strainer detent comprises a detent floor and the retention angle is defined between the detent sidewall and the detent floor.

13. The nesting product packaging system of claim 1, wherein the nesting pitch reduction channel comprises an outer nesting surface positioned to engage with a lower portion of the container and an inner bevel disposed opposite the outer nesting surface and extending to an upper surface of the strainer insert.

* * * * *